United States Patent [19]

Schaad et al.

[11] 4,392,029

[45] Jul. 5, 1983

[54] PUSH BUTTON SWITCH HAVING LATCHING SPRING ARM MOLDED ON PLASTIC CASING

[75] Inventors: William J. Schaad, Winnetka; Charles E. Black, III, Mount Prospect; Raymond T. Halstead, Wheeling, all of Ill.

[73] Assignee: Indak Manufacturing Corp., Northbrook, Ill.

[21] Appl. No.: 287,690

[22] Filed: Jul. 28, 1981

[51] Int. Cl.[3] ..... H01H 9/20

[52] U.S. Cl. ..... 200/5 B; 200/5 E; 200/50 C

[58] Field of Search ..... 200/5 E, 5 EA, 5 EB, 200/50 C, 328, 5 B, 5 C, 5 D

[56] References Cited

U.S. PATENT DOCUMENTS

| | | | |
|---|---|---|---|
| 3,392,598 | 7/1968 | Waldorf et al. | 200/328 X |
| 3,560,674 | 2/1971 | Lewis | 200/5 E X |
| 3,592,985 | 7/1971 | Arneberg | 200/5 E X |
| 3,952,175 | 4/1976 | Gulbeck et al. | 200/328 X |
| 4,213,017 | 7/1980 | Lewis | 200/50 C X |

*Primary Examiner*—J. R. Scott

*Attorney, Agent, or Firm*—Burmeister, York, Palmatier, Hamby & Jones

[57] ABSTRACT

A push button switch is disclosed comprising first and second spring returned push buttons movable in a resinous plastic casing along parallel paths, switching contacts in the casing and operable by the first push button, a flexible resilient latching spring arm molded in one piece with the casing and extending between the push buttons, cooperative latching elements on the first push button and the latching spring arm for causing deflection of the spring arm followed by latching of the first push button in its depressed position, and cooperative unlatching elements on the second push button and the spring arm for deflecting the arm and thereby causing disengagement of the latching elements in response to depression of the second push button. A third push button may also be provided to operate momentary switching contacts in the casing, with interengaging elements on the third and first push buttons for causing depression and latching of the first push button when the third push button is depressed and released.

8 Claims, 133 Drawing Figures

56
212
248
320
214
250
328
244
330
246
242
276
278
56
274

214
262
270
258
254
272
276

214
270
258
254
272

58
174
176
178
180
59
172
266
256
260
256
180
172
268
174
178
176
268
246
59

266
192
190
194
268
58

212
210
216
214
246
242
276
278
274

214
232
212
216
244
276
274
278

212
214
66
306
296
294
298
302
232
66

302
296
308
294
298
232

216
304
292
290
232
236
288

310
296
294
292
232
290

304
312
294
296
232
300

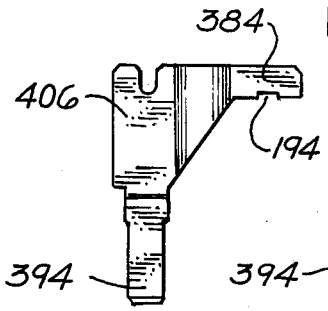
FIG. 93
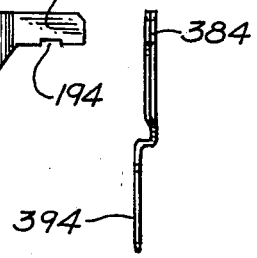
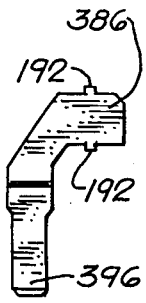
FIG. 95
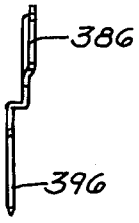
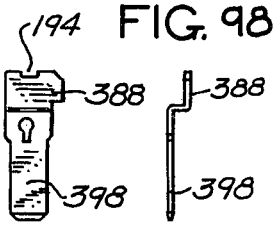
FIG. 97
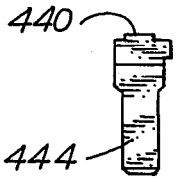
FIG. 99
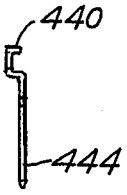
FIG. 100
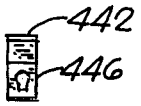
FIG. 102
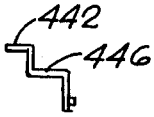
FIG. 103
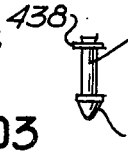
FIG. 105
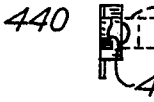
FIG. 101
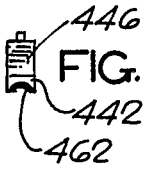
FIG. 104
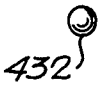
FIG. 106
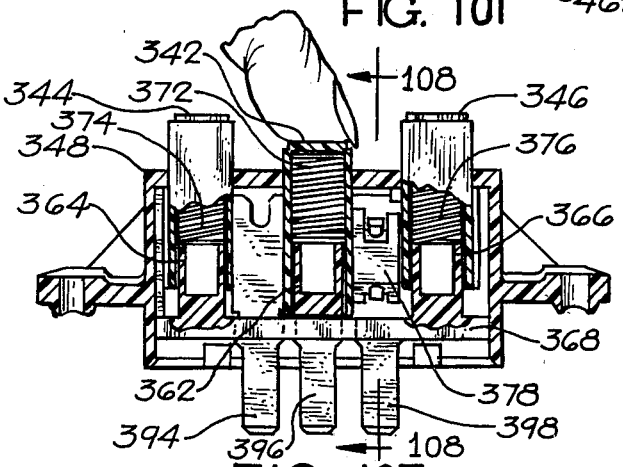
FIG. 107
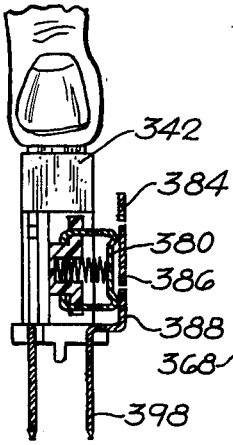
FIG. 108
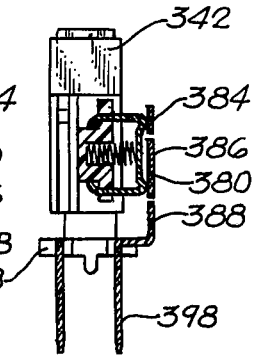
FIG. 109
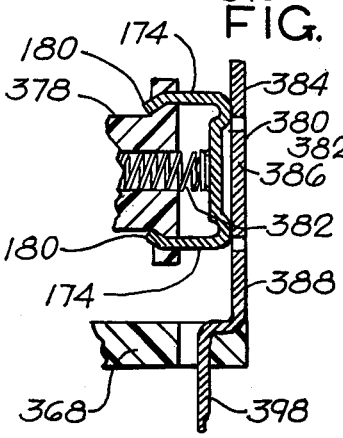
FIG. 110
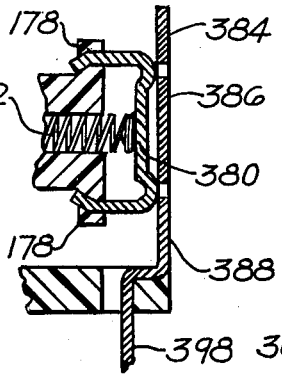
FIG. 111
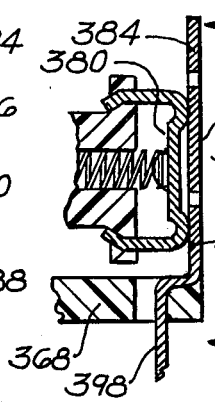
FIG. 112
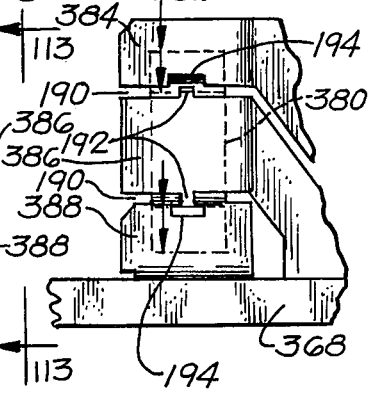
FIG. 113

PUSH BUTTON SWITCH HAVING LATCHING SPRING ARM MOLDED ON PLASTIC CASING

CROSS REFERENCE TO RELATED APPLICATIONS

Certain portions of the subject matter disclosed in this application are claimed in the applicants' divisional applications Ser. No. 421,819, filed Sept. 23, 1982 and Ser. No. 421,820, filed Sept. 23, 1982.

1. Field of the Invention

This invention relates to electrical switches, particularly push button switches, which will find many applications, but are particularly well suited for automotive service, as components in automobiles, trucks and other vehicles.

2. Background and Objects of the Invention

One object of the present invention is to provide a line or series of new and improved push button switches, having a variety of features in common, while also having various individual features, capable of performing a wide range of switching functions.

A further object is to provide a series of new and improved push button switches of the foregoing character, which are sturdy, compact and highly serviceable, while also being attractive in appearance and low in cost.

Another object is to provide new and improved push button switches in which most of the components of the switches are made of moldable resinous plastic materials, so that the use of metal parts in the switches is minimized.

A further object is to provide a new and improved push button switch having a single push button which is spring returned and is adapted to produce momentary electrical contact.

Another object is to provide a new and improved push button switch of a modified construction utilizing two push buttons, with a blocking action so that only one of the push buttons can be depressed at any one time.

A further object is to provide a new and improved push button switch of another modified construction, having one push button which latches in its depressed position, and another push button which is effective, when depressed, to unlatch the first push button.

Another object is to provide a new and improved push button switch of the foregoing character, in which all of the latching and unlatching elements are made of a moldable resinous plastic material.

A further object is to provide new and improved push button switches having improved contactor and contact constructions.

Another object is to provide new and improved push button switches having improved means for guiding and stabilizing the movement of the push buttons.

SUMMARY OF THE INVENTION

To achieve these and other objects, the present invention may provide a push button switch, comprising a push button, a casing having guide means for guiding the push button along a path between extended and depressed positions, resilient means biasing the push button toward said extended position, a carriage member extending laterally from the push button, a conductive contactor mounted on the carriage member and movable in the casing along a path which is parallel with the path of the push button, contact means in the casing and selectively engageable by the contactor, and spring means acting between the carriage member and the contactor to afford spring pressure between the contactor and the contact means.

The push button may have a noncircular cross-section and may be guided in a noncircular opening in the casing for stabilizing the push button against rotation due to the force of the spring means.

The push button may be hollow, for slidably receiving an internal guide member in the casing. A compression spring may be received within the push button and may be compressed between the push button and the internal guide member. A hollow space may be formed in the internal guide member for receiving a lamp to illuminate the interior of the push button, which may have a light transmitting portion.

The guide means for the push button may include a backup guide member, such as a rail in the casing, slidably engaging the carriage member on the side thereof opposite from the contactor.

The contact means may include at least first and second conductive plates having respective first and second terminal members extending to the outside of the casing. The contact plates may be backed up by a wall of the casing, and such wall may have flange means for receiving edge portions of such plates to retain the plates in close proximity to the wall.

The contact plates may be coplanar and may have adjacent edge portions with a gap therebetween. One of the edge portions may be formed with a notch, while the other may be formed with a finger extending across such space and opposite such notch for smoothly carrying the contactor across such gap.

The present invention may provide a modified push button switch, comprising first and second parallel push buttons, a casing having first and second guide means for guiding the first and second push buttons along parallel closely spaced paths, for movement between extended and depressed positions, resilient means biasing each of the push buttons toward its extended position, first and second switching means operable by movement of the first and second push buttons, a flexible blocking arm molded in one piece with the casing from a resinous plastic material and extending between the first and second push buttons, and first and second deflecting elements on the respective push buttons for deflecting the blocking arm in opposite directions when the first and second push buttons are depressed, the deflection of the blocking arm by either of the deflecting elements being effective to move the blocking arm into the path of the other deflecting element to block the depression of the other push button, whereby only one of the push buttons can be depressed at one time.

The blocking arm may have first and second oppositely sloping ramp surfaces for engagement by the respective first and second deflecting elements on the push buttons. The first and second deflecting elements may have first and second oppositely sloping ramp surfaces corresponding with and engageable with the oppositely sloping ramp surfaces on the blocking arm.

The present invention may provide another modified push button switch, comprising first and second parallel push buttons, a casing having first and second guide means for guiding the first and second push buttons along parallel closely spaced paths between extended and depressed positions, resilient means biasing each of the push buttons toward its extended position, switching means in the casing and operable by movement of the first push button, the casing being molded from a resinous plastic material and having a flexible latching arm molded in one piece with the casing and extending between the first and second push buttons, cooperative latching elements on the first push button and the latching arm for latching the first push button in its depressed position, and cooperative unlatching elements on the second push button and the arm for deflecting the arm and thereby causing disengagement of the latching elements in response to depression of the second push button.

The latching elements may comprise latching ratchet teeth on the first push button and the latching arm for causing deflection of the arm in response to depression of the first push button followed by return movement of the arm to bring the teeth into a latching relationship. The unlatching elements may comprise camming elements on the second push button and the arm for deflecting the arm to cause disengagement of the latching ratchet teeth in response to depression of the second push button.

The switch may include a third spring returned push button which, when depressed, produces momentary closure of additional switch contacts, and also causes depression of the second push button, due to a mechanical interlock, the second push button becoming latched in its depressed position.

BRIEF DESCRIPTION OF THE DRAWINGS

Further objects, advantages and features of the present invention will appear from the following description, taken with the accompanying drawings, in which:

FIGS. 93 and 94 are side and edge views of a first fixed contact employed in the switch of FIG. 67.

FIGS. 95 and 96 are side and edge views of a second fixed contact for the switch of FIG. 67.

FIGS. 97 and 98 are side and edge views of a third fixed contact for the switch of FIG. 67.

FIGS. 99, 100 and 101 are side, edge and front views of a fourth fixed contact member for the switch of FIG. 67.

FIGS. 102, 103 and 104 are side, edge and front views of a fifth fixed contact member or bracket for the switch of FIG. 67.

FIGS. 105 and 106 are side and end views of a contactor for the WASH push button of the switch of FIG. 67.

FIG. 107 is a longitudinal section, taken generally along the line 107—107 in FIG. 70, and showing the switch with the ON push button depressed.

FIG. 108 is a transverse section, taken generally along the line 108—108 in FIG. 107, the switch being shown with the ON push button depressed and with the casing of the switch removed.

FIG. 109 is a section similar to FIG. 108, but with the ON push button in its extended position.

FIGS. 110, 111 and 112 are fragmentary enlarged sections, similar to FIG. 109, but showing the contactor for the ON push button in three successive positions, as the push button is moved between its extended and depressed positions.

FIG. 113 is a fragmentary side view, taken as indicated by the line 113—113 in FIG. 112.

DETAILED DESCRIPTION OF EMBODIMENTS

FIGS. 1-23 and 128 show a first illustrative embodiment of the invention, in the form of a switch having a single push button, which may be depressed to close an electrical circuit.

FIGS. 24-26 and 129 illustrate a second illustrative embodiment, in the form of a push button switch having two push buttons, designated ON and OFF, which may be depressed separately to close separate electrical circuits. A blocking mechanism prevents simultaneous depression of both push buttons.

Figure 67:
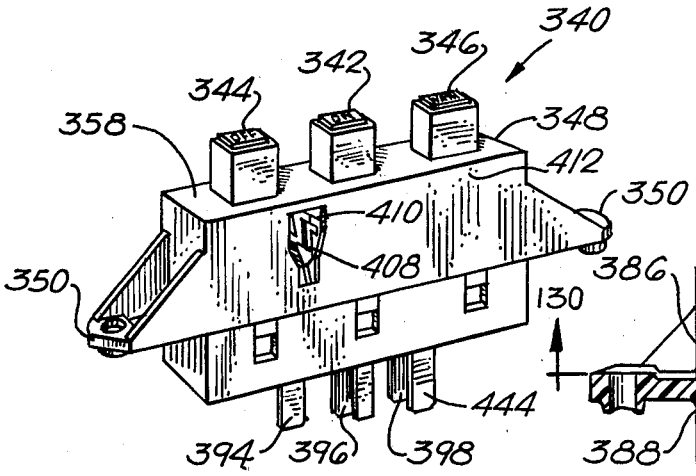
FIG. 67 is a perspective view showing a third push button switch, having three push buttons, to be described as a third illustrative embodiment of the present invention.
Figure 127:
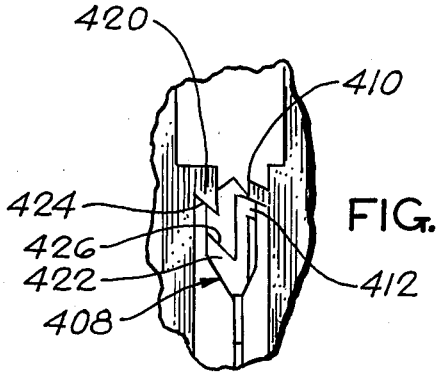
Figure 130:
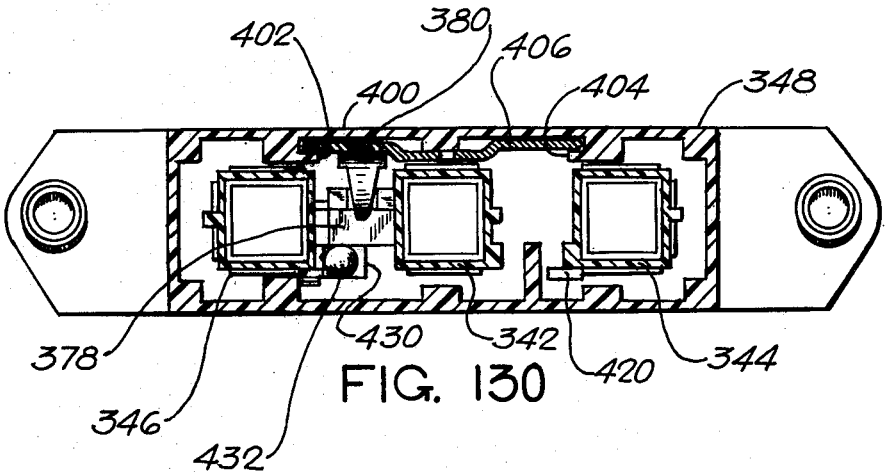
FIG. 130 is a transverse section taken through the third switch, generally along the line 130—130 in FIG. 72.

FIGS. 67-127 and 130 illustrate a third illustrative embodiment, in the form of a push button switch having three push buttons designated ON, OFF and WASH. The ON push button is latched in its depressed position, in which a windshield wiper motor may be energized, and is unlatched by depressing the OFF push button. Depression of the WASH button closes an electrical circuit and also causes depression of the ON push button.

Figure 131:
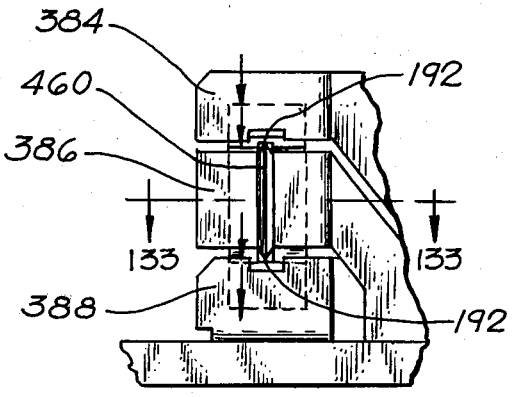
FIG. 131 is a fragmentary side view, similar to FIG. 113, but showing a modified construction, the view being taken generally as indicated by the line 131—131 in FIG. 132.
Figure 132:
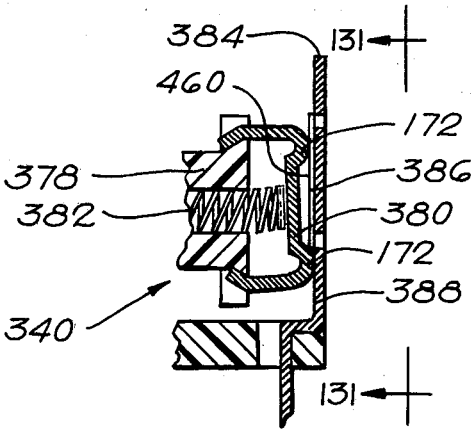
FIG. 132 is a fragmentary longitudinal section taken generally along the line 132—132 in FIG. 131.
Figure 133:
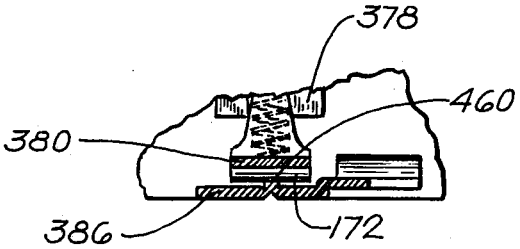
FIG. 133 is a fragmentary transverse section, taken generalle along the line 133—133 in FIG. 131.

FIGS. 131-133 illustrate a modified contact construction for the switch of FIGS. 67-127 and 130.

Figure 16:
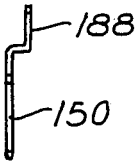
FIGS. 15 and 16 are side and edge views of the other fixed contact for the switch of FIG. 1.
Figure 15:
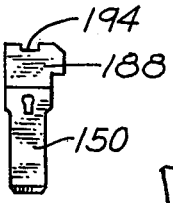

As already indicated, FIGS. 1-23 illustrate a push button switch 140, constituting a first illustrative embodiment of the present invention. The switch 140 has a single spring returned push button 142 which is slidably movable in a casing 144 between extended and depressed positions. The extended position is shown in FIGS. 1, 3, 5 and 6, while the depressed position is shown in FIG. 16.

Both the push button 142 and the casing 144 may be molded from a moldable resinous plastic material, of any suitable type, which is preferably strong and durable, yet light in weight, attractive in appearance and low in cost. The casing 144 is formed with a pair of integral mounting brackets 146.

The push button switch 140 includes switching means adapted to open and close an electrical circuit between conductive terminals 148 and 150, projecting out of the casing 144, which is preferably made of an electrically insulating material. The switch 140 may be of either the normally open type or the normally closed type, but is illustrated as being of the normally open type, in which the electrical circuit is open when the push button 142 is extended, and closed when the push button is depressed. The terminals 148 and 150 are adapted to receive a suitable electrical connector or receptacle, for connecting the switch 140 into an electrical circuit. The switch 140 has an additional prong 152, preferably made of an electrically insulating material, to serve the purpose of polarizing the electrical connector, so that it cannot be mounted backwards on the switch 140. The prong 152 is thicker than the terminals 148 and 150.

Figure 2:
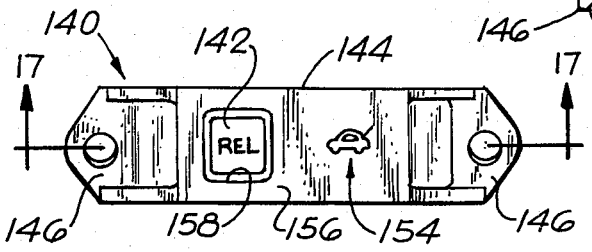
FIGS. 2, 3, 4 and 5 are front, side, rear and end views, respectively, of the switch of FIG. 1.
Figure 3:
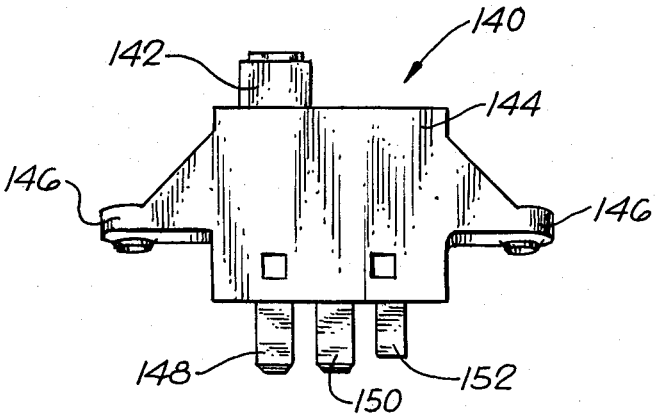
Figure 5:
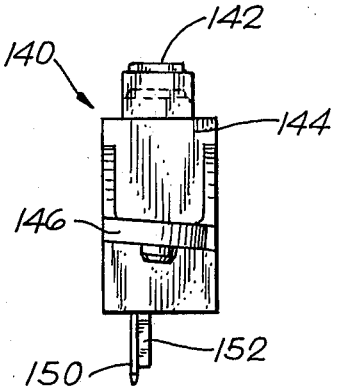
Figure 4:
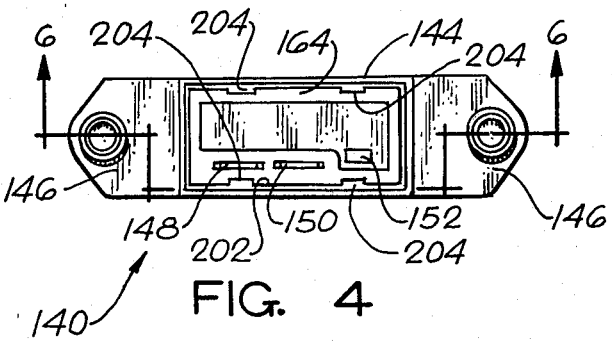
Figure 7:
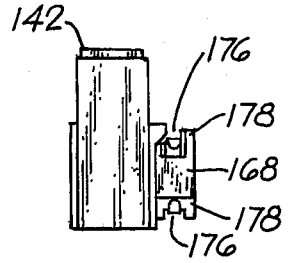
FIGS. 7, 8, 9 and 10 are four side views showing the four sides of the push button assembly for the switch of FIG. 1, FIG. 8 being partially in section.
Figure 8:
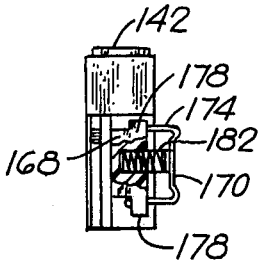
Figure 9:
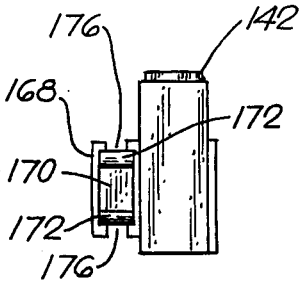
Figure 10:
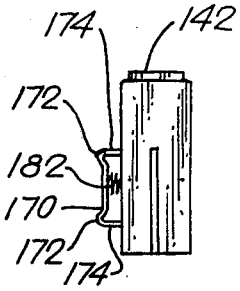
Figure 11:
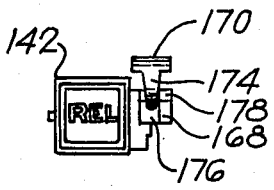
FIGS. 11 and 12 are front and rear views of such push button assembly.

The push button switch 140 is well adapted for many switching applications which call for momentary closure of an electrical circuit. For example, the switch 140 may be employed to energize a hatch release solenoid, which releases the hatch lock on an automobile, so that the hatch will swing open. To indicate this function, the push button 142 is marked with the legend REL, meaning Release. Moreover, the front of the casing 144 is marked with a pictorial hatch release symbol 154, as shown in FIG. 2.

The push button 142 has a noncircular cross section, being square in this instance. Moreover, the casing 144 is formed with a front wall 156 having a noncircular opening 158 for guiding the push button 142. The noncircular shape of the push button 142 and the guide opening 158 prevents any rotation of the push button 142 in the opening 158.

Figure 12:
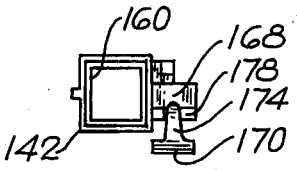
Figure 13:
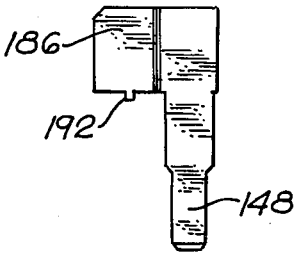
FIGS. 13 and 14 are side and edge views of one of the fixed contacts for the switch of FIG. 1.
Figure 14:
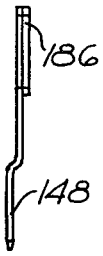
Figure 17:
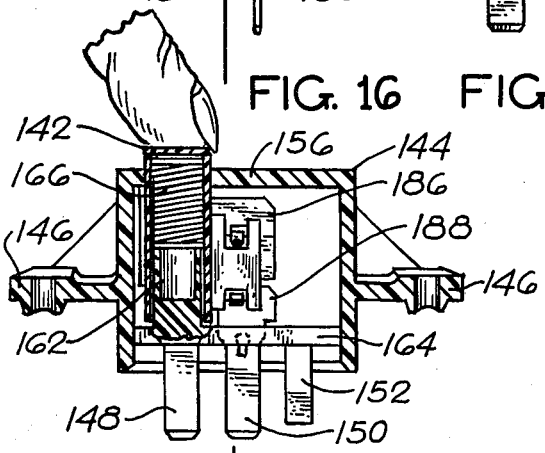
FIG. 17 is a longitudinal section, taken generally along the line 17—17 in FIG. 2, showing the switch with its push button depressed.

In addition to the guide opening 158, further guide means are provided within the casing 144 for the push button 142. As shown in FIGS. 12 and 17, the push button 142 is hollow and thus is formed with an interior space or guide opening 160. The casing 144 is provided with a guide member 162 which is slidably received in the interior guide opening 160 in the push button 142. In this case, the guide member 162 is circular in cross section and is molded in one piece with the rear wall 164 of the casing 144. The push button 142 is provided with a return spring 166, which in this case is of the coiled compression type and is housed in the space 160 within the push button 142. The spring 166 is compressed between the stationary guide member 162 and the front of the push button 142, as shown in FIG. 17.

As shown in FIGS. 6–12, the push button 142 is formed with a carriage 168, adapted to carry a contactor 170 which is movable with the push button. The contactor 170 is made of copper or some other electrically conductive material. The carriage 168 may be molded in one piece with the push button 142, using an electrically insulating resinous plastic material. The carriage 168 is in the form of a member projecting laterally from the rear portion of the push button 142 within the casing 144. The carriage 168 is engageable with the front wall 156 of the casing 144 to limit the outward movement of the push button 142, due to the biasing force of the spring 166.

The illustrated contactor 170 is in the form of a conductive metal plate 170, having its opposite ends formed with a pair of projecting ridges or beads 172, serving as contact riders. The contactor 170 has a pair of supporting fingers or tabs 174, bent generally at right angles to the contactor 170 and extending through slots or notches 176 formed in flanges 178 on the carriage 168. The fingers 174 have inturned end portions 180 which interlock with the flanges 178 on the carriage 168 so as to retain the contactor 170 on the carriage 168. To provide for resilient means to develop contact pressure, a coil spring 182 is compressed between the contactor 170 and the carriage 168, as shown to best advantage in FIG. 20. The carriage 168 may be formed with a recess or socket 184 to receive and locate the spring 182.

Figure 6:
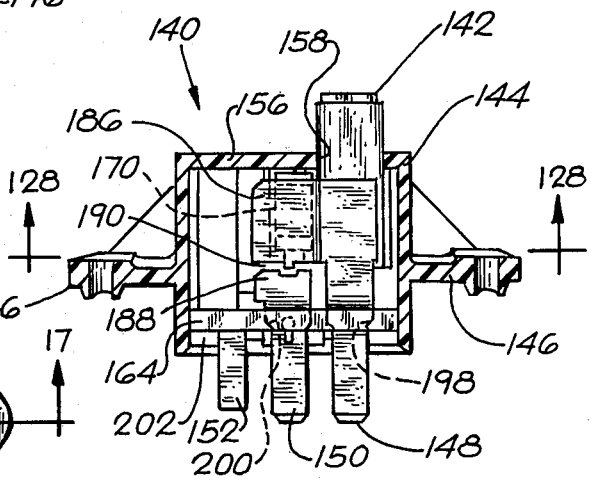
FIG. 6 is a longitudinal section, taken generally along the line 6—6 in FIG. 4.
Figure 19:
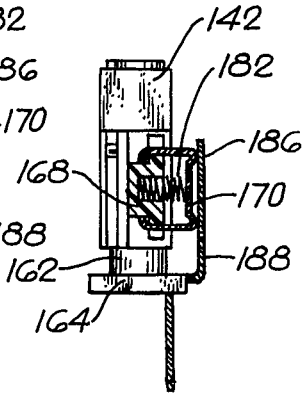
FIG. 19 is a view similar to FIG. 18, but with the push button in its extended position.
Figure 20:
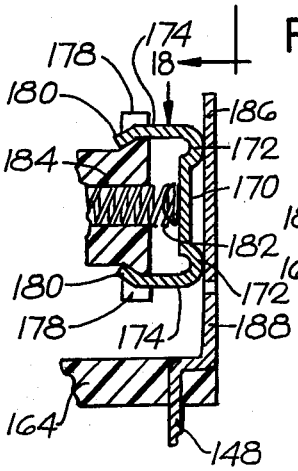
FIGS. 20, 21 and 22 are fragmentary enlarged sections, similar to a portion of FIG. 18, showing successive positions of the contactor of the switch as the push button is moved between its extended or open position and its depressed or closed position.

The contactor 170 is engageable with fixed contacts 186 and 188, which in this case are in the form of plates made of copper or some other electrically conductive material. The illustrated contact plates 186 and 188 are formed in one piece with the electrical terminals 148 and 150. When the push button 142 is in its extended position, as shown in FIGS. 6, 19 and 20, the bead-shaped riders 172 of the contactor 170 engage only the contact plate 186, and not the contact plate 188, so that there is no electrical connection within the switch 140, between the terminals 148 and 150. When the push button 142 is depressed, as shown in FIGS. 17, 18, 22 and 23, the two contact riders 172 of the contactor 170 engage both of the contact plates 186 and 188, so that the contactor forms a conductive bridge between the contact plates. Thus, the electrical terminals 148 and 150 are connected together by the contactor 170.

Figure 23:
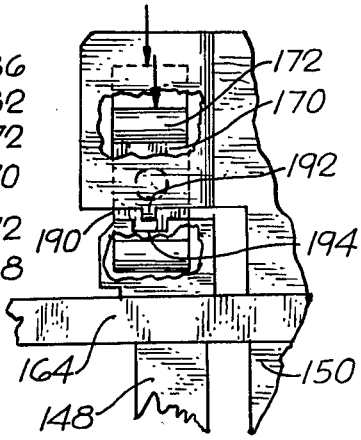
FIG. 23 is a fragmentary side view, taken generally as indicated by the line 23—23 in FIG. 22, with portions of the fixed contacts broken away.

It will be seen from FIGS. 6, 17 and 23 that there is a gap 190 between the contact plates 186 and 188, and that one of the bead-shaped contact riders 172 of the contactor 170 is movable across such gap. To facilitate such movement in a smooth manner, one contact plate 186 is formed with a finger or projection 192, extending across such gap 190, while the other contact plate 188 is formed with a notch 194, opposite the projection 192, so that the projection 192 does not form an electrically conductive bridge across the gap 180. In moving across the gap 190, the rear contact rider 172 of the contactor 170 moves smoothly along the finger or projection 192, so that the rider 172 comes into engagement with the contact plate 188, just as the rider moves out of engagement with the projection 192. Thus, the provision of the projection 192 and the notch 194 obviates any substantial detent action between the contact rider 172 and the gap 190.

It will be evident from FIGS. 18–22 that the contactor spring 182 biases the contactor 170 toward the contact plates 186 and 188, so as to produce contact pressure between the contactor and the contact plates. The force of the spring 182 reacts against the carriage 168, and thus tends to have a twisting effect upon the push button 142. However, the carriage 168 is backed up by a guide element 196 in the casing 144, such guide element 196 being shown in FIG. 128 as a rail along which the carriage 168 is slidable, as the push button 142 is moved between its extended and depressed positions. Thus, the guide rail 196 takes up the force of the contactor spring 182, so that such force does not actually cause twisting movement of the push button 142.

The electrical terminals 148 and 150 extend through and are supported by the rear wall 164 of the casing 144 for the switch 140. The terminals 148 and 150 are closely fitted through slots 198 and 200 in the rear wall 164 and are staked or otherwise secured in place. The terminals 148 and 150 support the contact plates 186 and 188.

The casing 144 of the switch 140 is illustrated in the form of a generally rectangular box having a rear opening 202 into which the rear wall 164 is snapped. The rear wall 164 is generally in the form of a terminal supporting board or plate. In assembling the switch, the rear wall 164 is forced into the rear opening 202 in the casing 144, until the rear wall 164 snaps past ratchet teeth or barbs 204 (FIG. 4), which retain the rear wall 164 in the casing 144.

Figure 128:
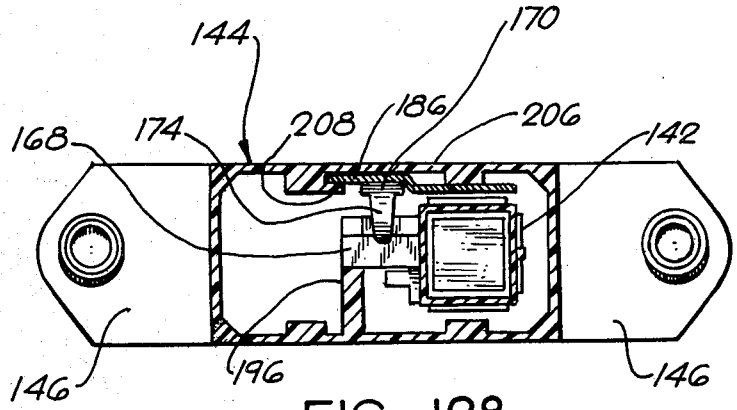
FIG. 128 is a transverse section taken through the first switch, generally along the line 128—128 in FIG. 6.

As shown in FIG. 128, the contact plates 186 and 188 extend along the inside of one wall 206 of the plastic casing 144, such wall 206 being the upper wall of the casing when the switch 140 is in its normal position of use. To ensure that the contact plate 186 is properly positioned along the wall 286, a flange 208 is formed in one piece with the wall 206, so that the contact plate 186 is received and retained between the flange 208 and the wall 206, as shown in FIG. 128. The flange 208 overlaps the left hand portion of the contact plate 186, as shown in FIG. 128. When the switch is assembled, the contact plate 186 is slid between the flange 208 and the wall 206. The flange 208 straightens the contact plate 186, even if it has been slightly bent by handling, and insures that the contact plate 186 is held in close proximity with the wall 206 of the casing 144, so that the contact plate 186 is in the correct relationship with the contactor 170. The contact plate 186 is in the same plane as the contact plate 188, which is also in close proximity with the wall 208.

Figure 1:
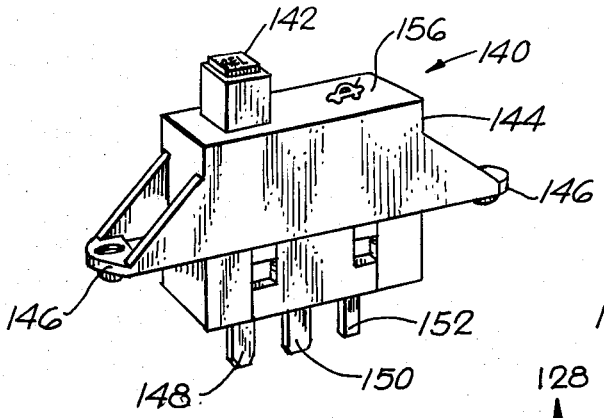
FIG. 1 is a perspective view of a first push button switch to be described as a first illustrative embodiment of the present invention, such switch having a single push button.

In the operation of the push button switch 140 shown in FIGS. 1–23 and 128, the push button 142 is initially biased to its extended position, as shown in FIGS. 1 and 6, by the return spring 166. In this position, both contact riders 172 of the contactor 170 engage the contact plate 186, as shown in FIGS. 19 and 20. Thus, there is an open circuit condition between the electrical terminals 148 and 150.

Figure 18:
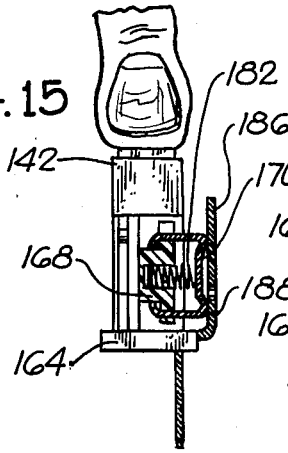
FIG. 18 is a transverse section, taken generally along the line 18—18 in FIG. 17, showing the switch with the push button depressed and with the casing of the switch removed.
Figure 21:
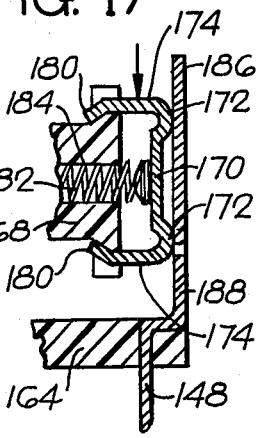
Figure 22:
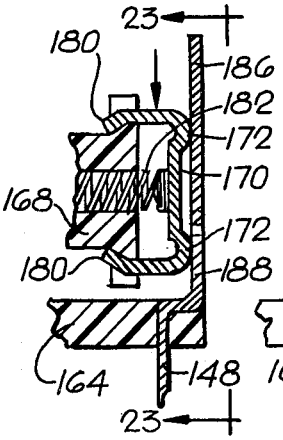

The push button 142 may be manually depressed, as shown in FIGS. 17 and 18. In the course of such depression, the contactor 170 is moved rearwardly with the push button 142. The rear contact rider 172 of the contactor 170 is carried over the gap 190 between the contact plates 186 and 188 by the finger or projection 192 on the plate 186. Thus, there is no substantial detenting action between the rear contact rider 172 and the gap 190. This transition is shown in FIG. 21. The rear contact rider 172 engages the contact plate 188, as shown in FIGS. 22 and 23, whereupon the contactor 170 forms a bridge between the contact plates 186 and 188, so that the electrical terminals 148 and 150 are connected together by the contactor 170. When the push button 142 is released, the push button and the contactor 170 return to their original positions.

During the movement of the push button 142, the carriage 168 slides along the guide element or rail 196, which takes up the force of the contactor spring 182, so that the carriage 168 and the push button 142 are stabilized against twisting movement or rotation. The push button 142 is also guided by its engagement with the square opening 158 in the front wall 156 of the casing 144, and also by the cylindrical guide member 162, which is slidably received in the opening 160 within the push button 142.

A second embodiment of the present invention is shown in FIGS. 24–66 and 129, in the form of a push button switch 210 having two push buttons 212 and 214 which are movable along parallel paths in a casing 216. The push buttons 212 and 214 and the casing 216 are preferably molded from a suitable resinous plastic material. The casing 216 is formed with integral mounting brackets 218 and 220. Each of the push buttons 212 and 214 is similar to the push button 142 previously described. The casing 216 is also similar to the casing 144, previously described. However, various differences will be described presently.

The push button switch 210 will find many applications, but is intended particularly for use as an ON-OFF switch for a rear window defogging heater on an automobile. Thus, the push button 212 is labelled ON, while the push button 214 is labelled OFF. The push button 212 is provided with a light transmitting jewel or window 222 which is adapted to be illuminated by a lamp within the casing 216. The window 224 identifies the switch 210 as a rear window defogger switch.

Figure 29:
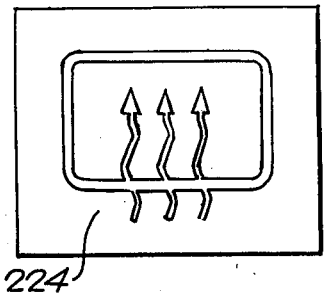
FIG. 29 is an enlarged view showing the illuminated indicator or pilot light for the switch of FIGS. 24 and 25.
Figure 25:
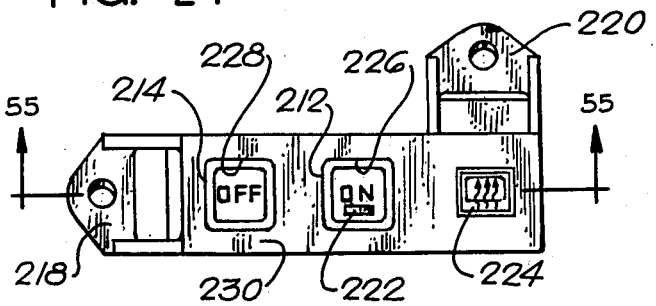
FIGS. 25, 26, 27 and 28 are front, side, rear and end views, respectively, of the switch of FIG. 24.
Figure 30:
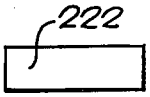
FIGS. 30, 31, 32 and 33 are front, side, end and rear views of a light transmitting window or jewel for the ON push button of the switch shown in FIGS. 24 and 25.
Figure 32:
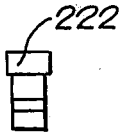
Figure 31:
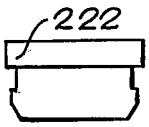
Figure 33:
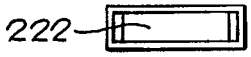
Figure 26:
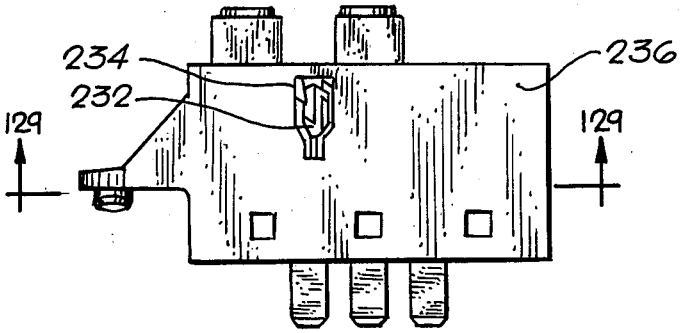
Figure 28:
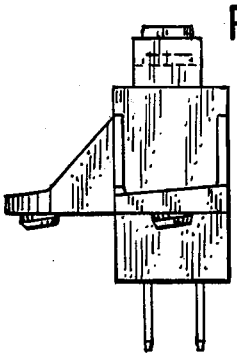

FIG. 29 shows the window 224 on an enlarged scale. FIGS. 30–33 illustrate the jewel or window 222 on an enlarged scale.

The push buttons 212 and 214 are noncircular in cross-section, being square as illustrated, and are slidable in non-circular guide openings 226 and 228 in the front wall 230 of the casing 216.

The push button switch 210 has a blocking action, in that only one of the two push buttons 212 and 214 can be depressed at any one time. To assist in producing this blocking action, the switch 210 is provided with a flexible blocking arm 232 which is preferably molded in one piece with the resinous plastic casing 216. Such blocking arm 232 is visible in FIGS. 24 and 26 through an opening 234 in the lower casing wall 236. The provision of the opening 234 facilitates the molding of the flexible blocking arm 232.

Figure 36:
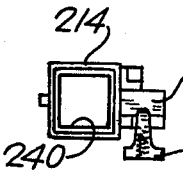
Figure 43:
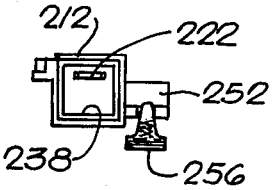
Figure 48:
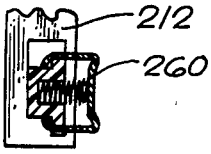
Figure 44:
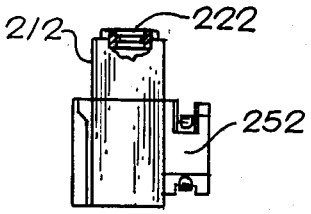
FIGS. 44, 45, 46 and 47 are four side views showing the four sides of such ON push button assembly, FIG. 45 being partly in section.
Figure 45:
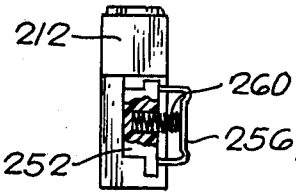
Figure 46:
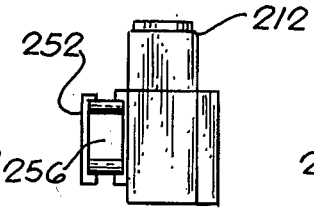
Figure 47:
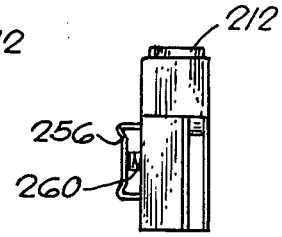
Figure 49:
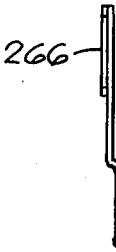
FIGS. 49 and 50 are edge and side views of one of the fixed contact members for the switch of FIG. 24.
Figure 50:
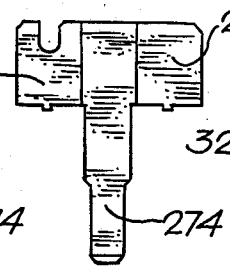

As before, the push buttons 212 and 214 are hollow and are provided with respective interior spaces 238 and 240 which are square in cross-section, as shown in FIGS. 36 and 43. Within the casing 216, the push buttons 212 and 214 are guided by guide members 242 and 244, shown in FIGS. 55, 60 and 61, which are cylindrical in shape, as shown, and are molded in one piece with the snap-in rear wall or terminal board 246 of the casing 216. The assembly of the rear wall 246 and the casing 216 may be substantially the same as previously described in connection with the casing 144 and the rear wall 164 of FIGS. 4 and 6.

Figures 55, 56, 57, 58, 59, 60, 61, 62, 63, 64, 65, 66:
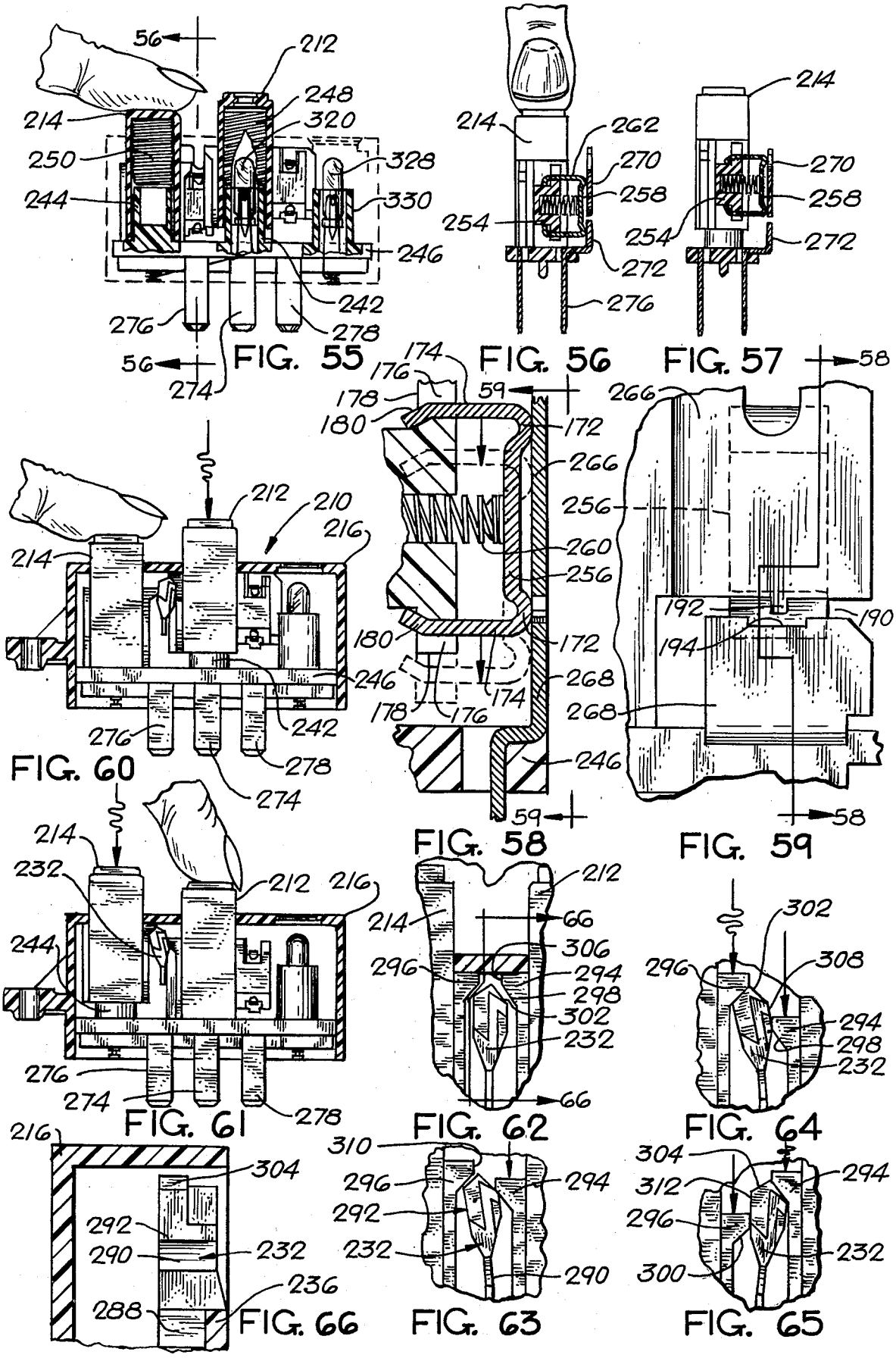
FIG. 55 is a longitudinal section, taken generally along the line 55—55 in FIG. 25, showing the switch with its OFF push button depressed.
FIG. 56 is a transverse section, taken generally along the line 56—56 in FIG. 55, showing the switch with its OFF push button depressed.
FIG. 57 is a view similar to FIG. 56, but with the OFF push button in its extended or open position.
FIG. 58 is a fragmentary enlarged section, similar to a portion of FIG. 57, and taken generally along the line 58—58 in FIG. 59.
FIG. 59 is a fragmentary enlarged side view, taken generally as indicated by the line 59—59 in FIG. 58.
FIG. 60 is a longitudinal section, showing the manner in which the depression of the OFF push button blocks the depression of the ON push button, in the switch of FIG. 24.
FIG. 61 is a longitudinal section, similar to FIG. 60, but showing the manner in which the depression of the ON push button blocks the depression of the OFF push button in the switch of FIG. 24.
FIG. 62 is a fragmentary enlarged side view, similar to a portion of FIG. 26, showing the movable blocking member, with both push buttons in their extended or open positions.
FIGS. 63 and 64 are views similar to FIG. 62, showing successive stages in the movement of the blocking member when the ON push button is depressed, the blocking of the OFF push button being shown in these views.
FIG. 65 is a view similar to FIG. 62, showing the movement of the blocking member when the OFF push button is depressed, the blocking of the ON push button being shown in this view.
FIG. 66 is a fragmentary section, taken generally along the line 66—66 in FIG. 62, showing the blocking member.

The push buttons 212 and 214 are provided with return springs in the form of compression coil springs 248 and 250, mounted within the push buttons and compressed between the push buttons and the guide members 242 and 244, as shown in FIG. 55.

The push buttons 212 and 214 are adapted to operate switching means which may be either normally open or normally closed but are illustrated as being normally open. The respective switching means are adapted to be closed by the depression of the individual push buttons 212 and 214. Each of the switching means, operable by the push buttons 212 and 214, may be similar to the switching means for the push button switch 140, previously described.

As shown in FIGS. 35–48, the push buttons 212 and 214 are provided with respective laterally projecting carriages 252 and 254, on which respective electrically conductive contactors 256 and 258 are mounted. These carriages and contactors are substantially the same as the carriage 168 and the contactor 170, previously described. Contactor springs 260 and 262 are compressed between the respective carriages 252 and 254 and the corresponding contactors 256 and 258, as before.

The contactors 256 and 258 are slidably engageable with fixed contacts in the form of contact plates which are very much the same as the contact plates 186 and 188, previously described. Thus, the contactor 260 for the ON push button 212 is engageable with contact plates 266 and 268, while the contactor 258 for the OFF push button 214 is engageable with contact plates 270 and 272, as shown in FIGS. 41 and 49–54. All of the contact plates may be made of copper or some other electrically conductive material. In this case, the contact plates 266 and 270 are formed in one piece with a common electrical terminal 274, extending through a slot in the rear wall or terminal board 246, and staked or otherwise secured thereto. The respective contact plates 268 and 272 are formed integrally with corresponding electrical terminals 276 and 278.

Figure 129:
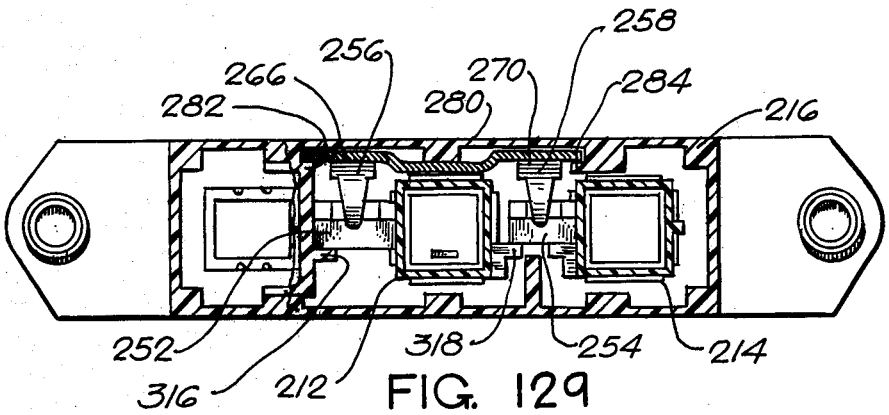
FIG. 129 is a transverse section taken through the second switch, generally along the line 129—129 in FIG. 26.

As shown in FIG. 129, the contact plates 266 and 270 are retained in a closely contiguous relationship with the upper casing wall 280 by flanges 282 and 284, molded in one piece with the casing wall 280. When the switch 210 is assembled, the contact plates 266 and 270 are slid between the wall 280 and the respective flanges 282 and 284.

As previously indicated, the push button switch 210 has a blocking action, whereby only one of the two push buttons 212 and 214 can be depressed at any one time. The flexible blocking arm 232 is employed to achieve such blocking action. The flexible blocking arm 232 is molded in one piece with the lower wall 236 of the casing 216. It will be seen from FIGS. 61–66 that the flexible blocking arm 232 extends forwardly between the push buttons 212 and 214.

The illustrated blocking arm 232 has a rear portion 288 which is joined integrally with the lower casing wall 236, a thin flexible intermediate portion 290 and an enlarged front portion or head 282. Due to this configuration, the flexible blocking arm 232 resembles a resilient pendulum.

As shown in FIGS. 62–65, the push buttons 212 and 214 are formed with respective deflecting elements 294 and 296, adapted to deflect the blocking arm 232 in opposite directions. FIG. 62 shows both push buttons 213 and 214 in their extended positions. When the push button 212 is depressed, as shown in FIG. 64, the deflecting element 294 deflects the blocking arm 232 to the left, so that the enlarged head 292 of the blocking arm 232 is swung fully into the path of the deflecting element 296, so that the push button 214 cannot be depressed. If the push button 214 is initially depressed, the deflecting element 296 deflects the blocking arm 232 to the right, as shown in FIG. 65, so that the head 292 of the blocking arm 232 is swung fully into the path of the deflecting element 294, so that the push button 212 cannot be depressed.

To produce the deflection of the blocking arm 232, the deflecting elements 294 and 296 are preferably formed with respective ramp or camming surfaces 298 and 300, engageable with ramp surfaces 302 and 304 on the enlarged head 292 of the flexible blocking arm 232.

The deflecting element 294 of the push button 212 has a straight or non-camming surface 306 which is movable opposite a straight or non-camming surface 308 on the enlarged head of the blocking arm 232, as shown in FIG. 64. Similarly, the deflecting element 296 on the push button 214 has a straight or noncamming surface 310 which is movable opposite a straight or noncamming surface 312 on the enlarged head 292 of the blocking arm 232.

As shown in FIG. 129, the carriage 252 on the push button 212 is slidably guided and backed up by a guide rail or flange 316 in the casing 216. The guide rail 316 takes up the force of the contactor spring 260 for the contactor 256.

The carriage 254 on the push button 214 is slidably backed up by a guide flange or rail 318 on the other push button 212, as shown in FIG. 129. The guide flange 318 takes up the force of the contactor spring 262 for the contactor 258.

Figure 27:
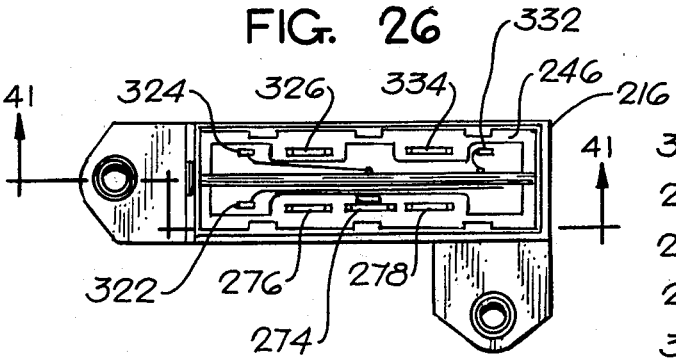
Figure 51:
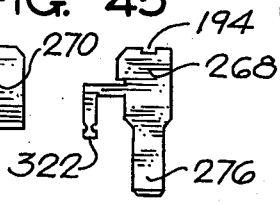
FIGS. 51 and 52 are side and edge views of another fixed contact member for the switch of FIG. 24.
Figure 52:
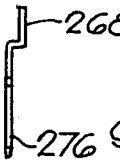
Figure 53:
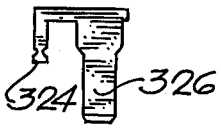
FIGS. 53 and 54 are side and edge views of a terminal member for the switch of FIG. 24.
Figure 54:
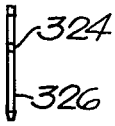

To provide for internal illumination of the ON push button 212, a lamp 320 is mounted within the hollow push button 212. A portion of the lamp 320 is mounted within the hollow cylindrical guide member 242 on the rear wall 246 of the casing 216. The lamp 320 has a pair of wire leads which are soldered or otherwise connected to small terminal lugs 322 and 324, projecting rearwardly from the rear wall 246, as shown in FIG. 27. The lug 322 is formed in one piece with the terminal 276, or is otherwise connected thereto, as shown in FIG. 51. The other lug 324 is formed in one piece or otherwise connected to another terminal 326, extending through a slot in the rear wall 246 and staked or otherwise secured thereto, as shown in FIGS. 27 and 53.

As shown in FIGS. 55 and 60, a second lamp 328 is provided to illuminate the window 224 in the casing 216. The second lamp 328 is mounted in an additional hollow cylindrical guide member 330, molded in one piece with the rear wall 246. The guide member 330 is similar to the guide members 242 and 244. One of the wire leads from the lamp 328 is soldered or otherwise connected to the previously mentioned lug 324, which is connected to the terminal 276. The other lead from the second lamp 328 is soldered or otherwise connected to a small terminal lug 332 which is formed in one piece or otherwise connected to a terminal 334, projecting rearwardly through a slot in the rear wall 246 and staked or otherwise secured thereto. The lug 332 and the terminal 334 may be the same in construction as the lug 324 and the terminal 326, as illustrated in FIG. 53.

Figure 34:
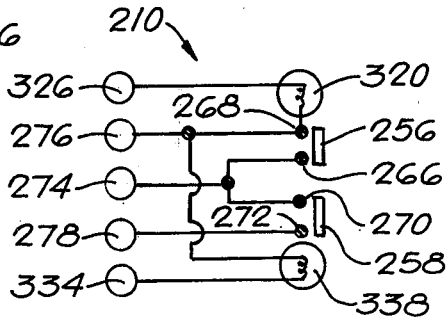
FIG. 34 is a schematic circuit diagram of the switch of FIG. 24.
Figure 35:
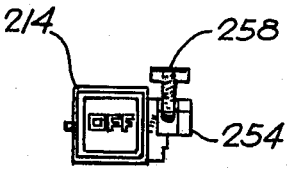
FIGS. 35 and 36 are front and rear views of the OFF push button assembly for the switch of FIG. 24.

FIG. 34 is a diagrammatic illustation of the push button switch 210, showing the electrical connections therein.

Figure 24:
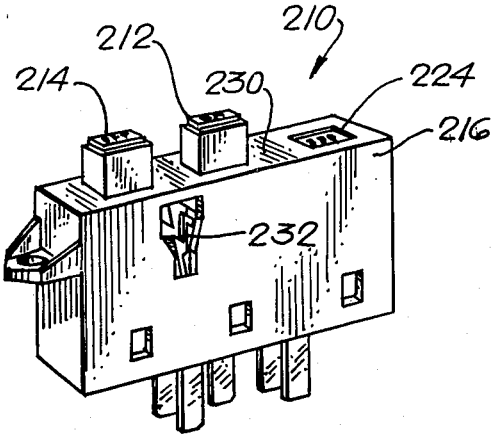
FIG. 24 is a perspective view of a second push button switch, having two push buttons, to be described as a second illustrative embodiment of the present invention.
Figure 41:
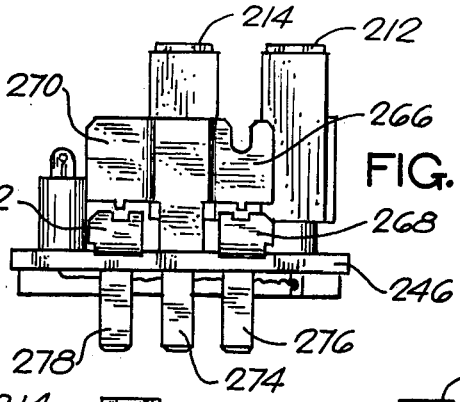
FIG. 41 is a sectional view, taken generally along the line 41—41 in FIG. 27.
Figure 37:
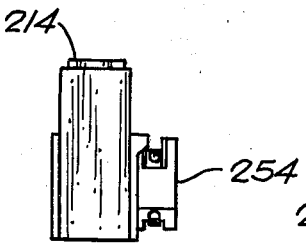
FIGS. 37, 38, 39 and 40 are four side views, showing the four sides of such OFF push button assembly.
Figure 38:
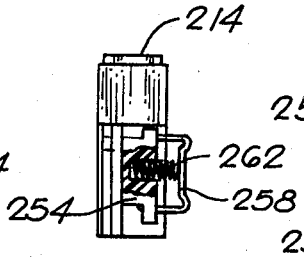
Figure 39:
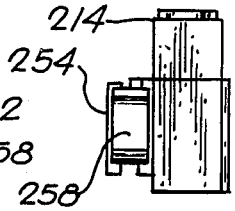
Figure 40:
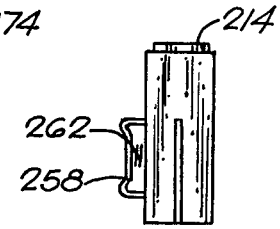
Figure 42:
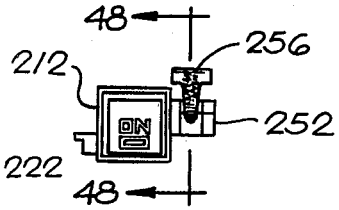
FIGS. 42 and 43 are front and rear views of the ON push button assembly for the switch of FIG. 24.

In the operation of the push button switch 210, both push buttons 212 and 214 are initially in their extended positions, as illustrated in FIGS. 24, 41 and 57. The initial position of the blocking arm 232 is shown to best advantage in FIG. 62.

The ON push button 212 may be depressed manually, as shown in FIG. 61, so as to cause the contactor 256 to move into engagement with the contact plate 268, as well as the contact plate 266, as shown in broken lines in FIG. 58. The full line position of the contactor 256 in FIG. 58 represents an intermediate or transitional position, in which the contactor is moving between the contact plates 266 and 268. When the push button 212 is depressed, the contactor 256 forms a conductive bridge between the contact plates 266 and 268, so that the terminals 274 and 276 are connected together. This circuit closure may be employed to energize any desired device, such as the timing relay for a rear window defogging heater.

When the ON push button 212 is depressed, the ramp surface 298 on the deflecting element 294 engages the ramp surface 302 on the blocking arm 232 and deflects the blocking arm to the left, as shown in FIG. 63. Further depression of the push button 212 brings the straight surface 306 on the deflecting element 294 into engagement with the straight surface 308 on the blocking arm 232, as shown in FIG. 64. The deflection of the blocking arm 232 moves the enlarged head 292 thereof into the path of the deflecting element 296 of the push button 214, so that the push button 214 is blocked against depression.

When the ON push button 212 is released, it is returned to its extended position by the return spring 248. The contactor 256 moves out of engagement with the contact plate 268, so that the contactor 256 engages only the contact plate 266. The deflecting element 294 and the resilient blocking arm 232 return to their initial positions, as shown in FIG. 62.

The OFF push button 214 may be depressed manually, as shown in FIGS. 55, 56 and 60. The contactor 258 is thereby moved into engagement with the contact plate 272, so that the contactor forms a conductive bridge between the contact plates 270 and 272. In this way, the contactor closes the circuit between the terminals 274 and 278. This may have the effect of deenergizing the timing relay or electronic circuit which controls the rear window defogging heater.

The depression of the OFF push button 214 causes the ramp surface 300 on the deflecting element 296 to engage the ramp surface 304 on the blocking arm 232, so that the blocking arm is deflected to the right, as shown in FIG. 65, following which the straight surface 310 on the deflecting element 296 engages the straight surface 312 on the blocking arm 232. The deflection of the arm 232 moves it into the path of the deflecting element 294 on the push button 212, so that the push button 212 is blocked against depression.

When the OFF push button 214 is released, it is returned to its extended position by the return spring 250, so that the contactor 258 returns to its initial position, as shown in FIG. 57, in which it engages only the contact plate 270.

The lamp 320 within the ON push button 212 may be energized whenever the rear window defogging heater is energized. The lamp 320 illuminates the jewel or window 222 in the front wall of the push button 212.

The second lamp 328 is generally energized continuously, along with the panel lamps of the automobile, to illuminate the window 224 in the casing 216, so as to identify the switch 210.

As shown in FIG. 129, the carriage 252 on the push button 212 is slidably guided and backed up by the guide rail 316, which takes up the force of the contactor spring 260 for the contactor 256. The carriage 254 on the push button 214 is slidably backed up by the flange or guide rail 318 on the push button 212. Thus, the flange 318 takes up the force of the contactor spring 262 for the contactor 258.

Certain details of the push button switch 210 of FIGS. 24–66 are the same as previously described and have been given the same reference characters as in the case of the push button switch 140 of FIGS. 1–23, so that the previous description can easily be applied. Such details include features of the contactors 256 and 258, such as the bead-shaped contact riders 172, the supporting fingers 174, the slots 176, the flanges 178, and the inturned end portions 180. Such details also include the gap 190 between the contact plates, the projection 192 for smoothly carrying the contactor across such gap, and the notch 194, opposite the projection 192. It will be seen from the drawings that various other features of the switch 210 are the same as in the case of the switch 140.

A third embodiment of the present invention is illustrated in FIGS. 67–127 and 130, in the form of a push button switch 340 having three push buttons 342, 344 and 346, labeled ON, OFF and WASH, which are movable along parallel paths in a casing 348. The push buttons and the casing are preferably molded from a suitable resinous plastic material. The casing 348 is formed with integral mounting brackets 350. As before, the push buttons 342, 344 and 346 are noncircular in cross-section, being square as illustrated, and are slidably guided in square openings 352, 354 and 356 in the front wall 358 of the casing 348.

The push button switch 340 will find many applications, but is intended particularly for controlling the operation of a windshield wiper motor and the associated windshield washer pump or the like. The windshield washer motor may be started by depressing the ON push button 342, which preferably latches in its depressed position. To stop the motor, the OFF push button 344 is depressed, with the result that the ON push button 342 is unlatched, so that it returns by spring action to its extended position. The OFF push button 344, when released, also returns by spring action to its extended position.

The wash pump may be energized by depressing the WASH push button 346. Due to a mechanical interlock, the depression of the WASH push button 346 also depresses and latches the ON push button 342.

Figure 72:
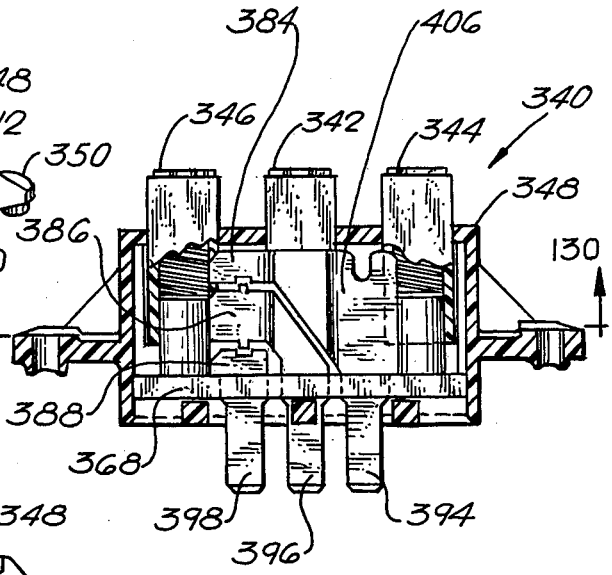
FIG. 72 is a longitudinal section, taken generally as indicated by the line 72—72 in FIG. 70.
Figure 68:
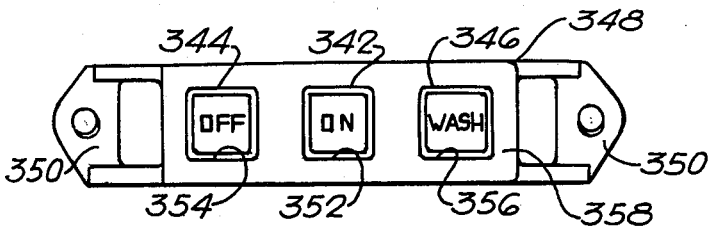
FIGS. 68, 69, 70 and 71 are front, side, rear and end views of the switch of FIG. 67.
Figure 69:
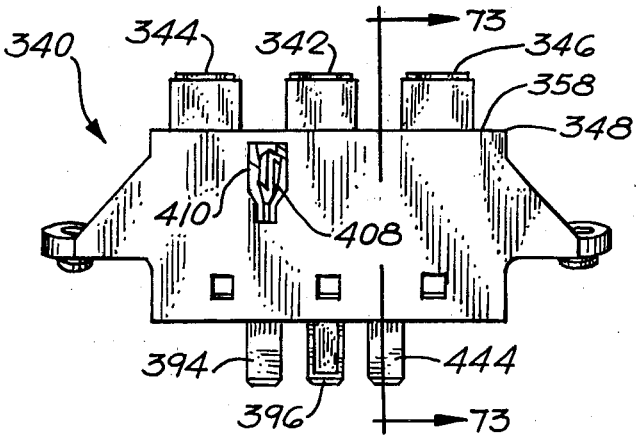
Figure 71:
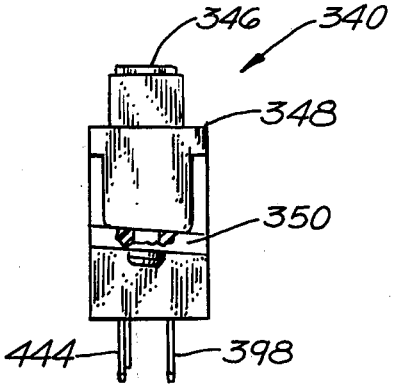
Figure 70:
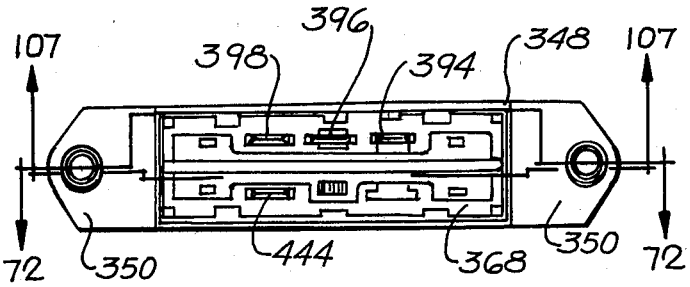

As shown in FIGS. 72 and 107, the push buttons 342, 344 and 346 are hollow, as before, and are internally guided by cylindrical guide elements 362, 364 and 366, molded in one piece with the rear wall 368 of the casing 348. The rear wall 368 may be assembled into the casing 348 in the same manner as described in connection with the switch 140.

The push buttons 342, 344 and 346 are movable between extended and depressed positions, and are biased toward their extended positions by respective springs 372, 374 and 376, illustrated as coil springs, received within the hollow push buttons and compressed between the push buttons and the respective guide members 362, 364 and 366, as shown in FIG. 107.

The ON push button 342 is provided with a laterally projecting carriage 378 which carries an electrically conductive contactor 380. A contactor spring 382 is provided between the carriage 378 and the contactor 380, such spring 382 being shown as a compression coil spring. The carriage 378, the contactor 380 and the spring 382, as shown in FIGS. 81–86, are substantially the same as the previously described carriage 168, contactor 170 and spring 182, shown in FIGS. 7–12. Some of the details of the carriage 378 and the contactor 380 have been given the same reference characters in FIGS. 81–86 as in the case of the carriage 168 and the contactor 170, so that the previous description will be readily applicable.

The contactor 380 is slidably engageable with three electrically conductive contact elements, illustrated as contact plates 384, 386 and 388, shown to best advantage in FIGS. 72 and 108–113. As before, the contactor 380 and the contact plates 384, 386 and 388 may be made of copper or some other electrically conductive material. As shown in FIG. 72, the illustrated contact plates 384, 386 and 388 are formed in one piece with electrical terminals 394, 396 and 398, extending through slots in the rear casing wall 368, and staked or otherwise secured thereto.

When the ON push button 342 is depressed, as shown in FIG. 108, the contactor 380 engages the contact plates 386 and 388, so as to form a closed circuit between the terminals 396 and 398. This closed circuit may be employed to energize the windshield wiper motor. When the ON push button 342 is extended, as shown in FIG. 109, the contactor 380 engages the contact plates 384 and 386, so as to form a closed circuit between the terminals 394 and 396. Such closed circuit may be employed to energize the parking circuit for the windshield wiper motor.

Certain features of the contact plates 384, 386 and 388 are the same as in the case of the contact plates 186 and 188 of FIG. 6. As to such features, the same reference characters have been employed, so that the previous description will be readily applicable. This is true particularly of the gap 190 between the contact plates, the projection 192 on one of the contact plates, for carrying the contactor across the gap in a smooth manner and with a minimum of detent action, and the notch 194 in the adjacent contact plate, opposite the projection 192. As shown in FIG. 113, there are two sets of these elements 190, 192 and 194. One set is between the contact plates 384 and 386, while the other set is between the contact plates 386 and 388.

It will be evident from FIGS. 72 and 108–113 that the contact plates 384, 386 and 388 are in the same plane. As shown in FIG. 130, such contact plates 384, 386 and 388 extend along the inside of the upper wall 400 of the casing 348. As before, the casing wall 400 is formed with an integral flange 402 for retaining the contact plates 384, 386 and 388 in close proximity with the wall 400. The flange 402 overlaps the edge portions of such contact plates. When the switch is assembled, the contact plates 384, 386 and 388 are slid between the wall 400 and the flange 402. It will be evident that the flange 402 is substantially the same as the flange 282 of FIG. 129. The wall 400 of FIG. 130 is formed with a second flange 404, which is substantially the same as the flange 284 of FIG. 129. The flange 404 overlaps the edge portion of a plate member 406 which extends between the contact plate 384 and the terminal 394 and is formed in one piece therewith. The flange 404 accurately positions and supports the plate member 406.

The latching of the ON push button 342 involves a flexible latching arm 408 which is molded in one piece with the casing 348, from a suitable resinous plastic material. The latching arm 408 is within the casing 348 but is visible through an opening 410 in the lower wall 412 of the casing 348. The opening 410 is provided to facilitate the molding of the flexible latching arm 408.

The general configuration of the flexible latching arm 408 is the same as that of the flexible blocking arm 232 of FIG. 66, and the description and illustration of FIG. 66 are fully applicable to the flexible latching arm 308. In order that the previous description may be fully applicable, the same reference characters 288, 290 and 292 have been employed in FIGS. 117–127 to identify the rear portion, the flexible intermediate portion, and the enlarged front portion or head of the flexible latching arm 408, respectively.

The ON push button 342 and the flexible latching arm 408 have cooperative latching elements for latching the ON push button is its depressed position. Such cooperative latching elements are illustrated in FIGS. 114–127 as taking the form of latching or ratchet teeth 410 and 412, on the push button 342 and the enlarged head 292 of the flexible latching arm 408, respectively. It will be seen that the ratchet teeth 410 and 412 are formed with interengageable ramp or cam surfaces 414 and 416, respectively.

Figures 117, 118:
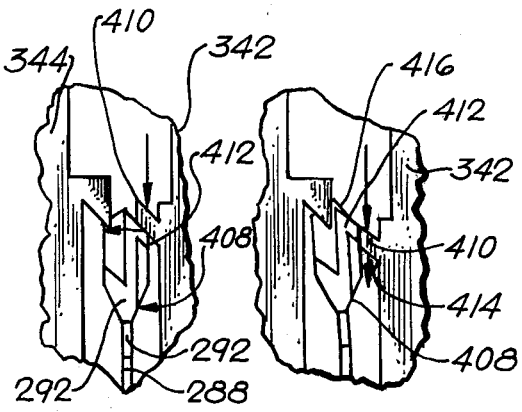
FIGS. 117, 118 and 119 are enlarged fragmentary side views showing three successive stages in the movement of the latching member as the ON push button is depressed and latched.
Figure 119:
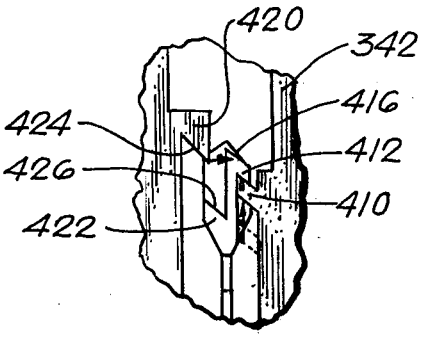
Figure 123:
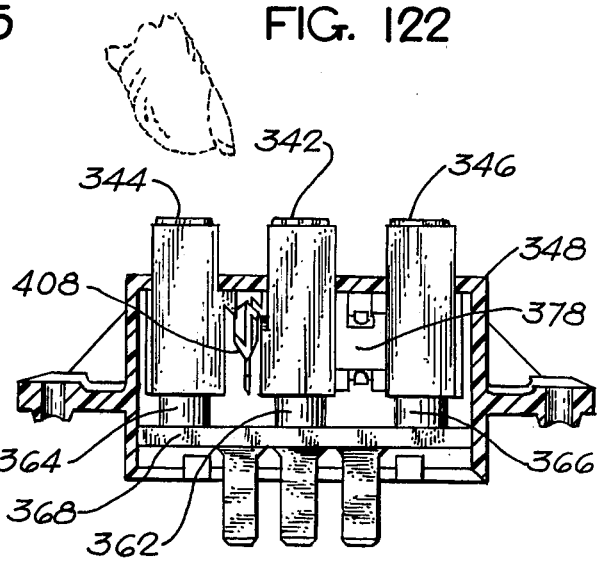
FIG. 123 is a longitudinal section, showing the return of the OFF push button to its extended position.

The ON push button 342 is shown in its initial or extended position in FIGS. 117 and 123. In this position, the latching arm 408 extends between the push buttons 342 and 344 and is not deflected. When the ON push button 342 is depressed, the ramp surface 414 on the ratchet tooth 410 engages the ramp surface 416 on the ratchet tooth 412 and causes deflection of the latching arm 408 to the left, as shown in FIGS. 117 and 118. This deflection enables the ratchet tooth 410 to move past the ratchet tooth 412, as shown in FIGS. 118 and 119, until the ratchet tooth 412 escapes from the ratchet tooth 410, whereupon the flexible latching arm 408 returns to its original or undeflected position, as shown in FIG. 119, so that the tooth 410 on the ON push button 342 is latched behind the tooth 412 on the latching arm 408. In this position, the contactor 380 forms a conductive bridge between the contact plates 386 and 388, as shown in FIGS. 108 and 112, so that the windshield wiper motor is energized.

Figure 125:
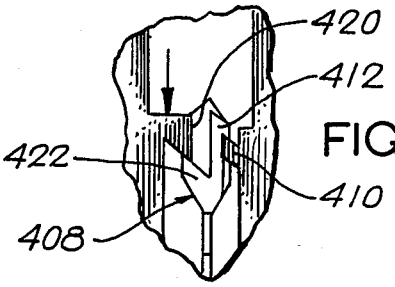
Figure 126:
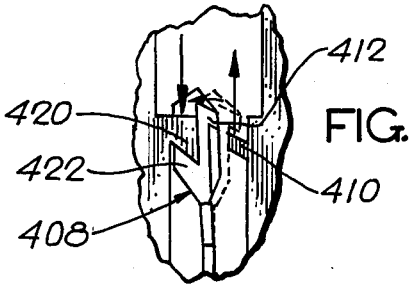
Figure 122:
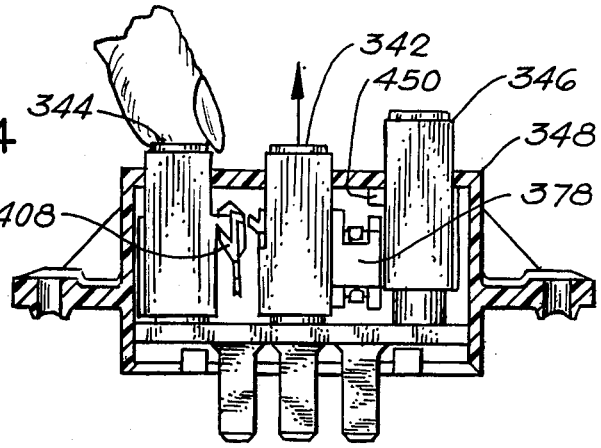
FIG. 122 is a longitudinal section, showing the manner in which the ON push button is unlatched by the depression of the OFF push button.

The ON push button 342 is unlatched by depressing the OFF push button 344, as shown in FIGS. 122 and 124–126. The OFF push button 344 and the enlarged head 292 of the latching arm 408 have unlatching elements which deflect the latching arm 408 to the left, as shown in FIGS. 122 and 126. Such unlatching elements are illustrated in the form of camming teeth 420 and 422 on the push button 344 and the enlarged head 292 of the latching arm 408, respectively. The teeth 420 and 422 have respective ramp surfaces 424 and 426.

In FIG. 24, the ON push button 342 is latched in its depressed position, while the OFF push button 344 is in its extended position. As the OFF push button 344 is depressed, the unlatching tooth 420 on such push button comes into engagement with the unlatching tooth 422 on the latching arm 408, as shown in FIG. 125. As the depression of the OFF push button 344 continues, the ramp surfaces 424 and 426 cause deflection of the latching arm 408 to the left, as shown in FIG. 126, with the result that the ratchet tooth 412 is moved out of engagement with the ratchet tooth 410. In this way, the ratchet tooth 410 is enabled to escape past the ratchet tooth 412, as the ON push button 342 is returned to its extended position, as shown in FIG. 127, by the return spring 372. When the OFF push button 344 is released, as shown in FIGS. 123 and 127, the OFF push button is released to its extended position by its return spring 274.

The depression of the WASH push button 346 is adapted to bring about a momentary closure of an electrical circuit which energizes the windshield washing pump or other washing device. As shown in FIGS. 87–92, the WASH push button 346 is formed with a laterally projecting carriage 430, molded in one piece therewith. The carriage 430 carries a tapered or conical contactor 432 made of copper or some other electrically conductive material. The contactor 432 has a cylindrical stem 434 which is slidable in a front-to-rear direction in a corresponding opening formed in the carriage 430. The contactor 432 is biased rearwardly by a spring 436, illustrated as a coil spring compressed between the contactor 432 and the carriage 430, the spring 436 being received around the stem 434. A stop 438 is mounted on the end of the stem 434 to retain the stem on the carriage 430. Such stop 438 is illustrated as a washer or disc, riveted or otherwise secured to the end of the stem 434.

Figure 73:
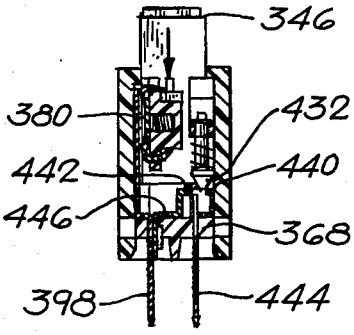
FIG. 73 is a transverse section, taken generally along the line 73—73 in FIG. 69.
Figure 74:
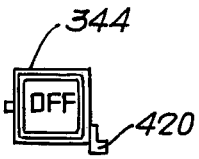
FIGS. 74 and 75 are front and rear views of the OFF push button for the switch of FIG. 67.
Figure 75:
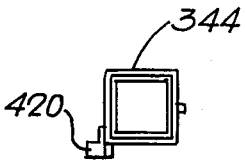
Figure 80:
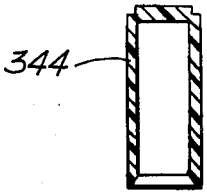
FIG. 80 is a longitudinal section, taken through the OFF push button.
Figure 76:
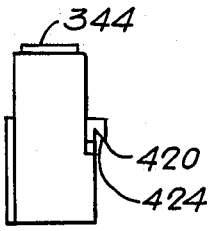
FIGS. 76, 77, 78 and 79 are four side views, showing the four sides of the OFF push button.
Figure 77:
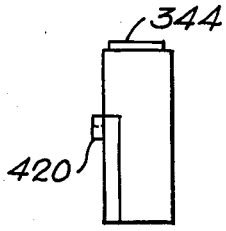
Figure 78:
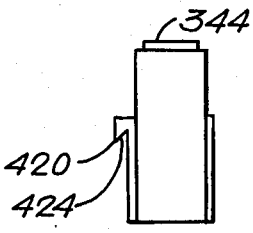
Figure 79:
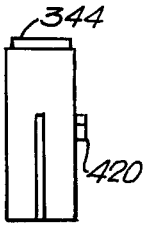
Figure 81:
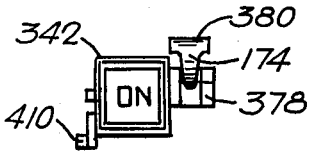
FIGS. 81 and 82 are front and rear views of the ON push button for the switch of FIG. 67.
Figure 82:
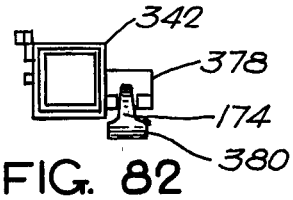
Figure 83:
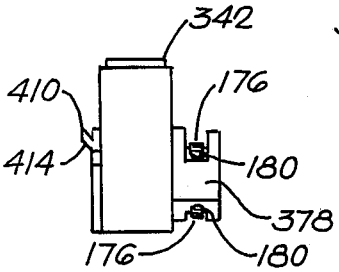
FIGS. 83, 84, 85 and 86 are four side views, showing the four sides of the ON push button for the switch of FIG. 67.
Figure 84:
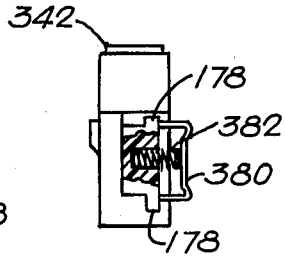
Figure 85:
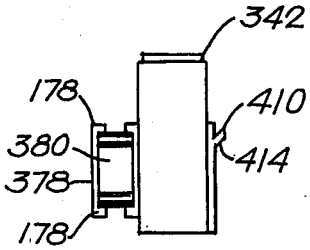
Figure 86:
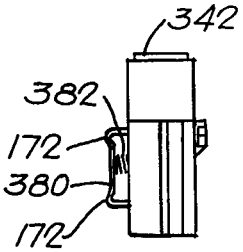
Figure 87:
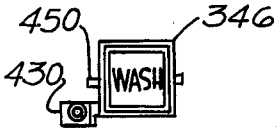
FIGS. 87 and 88 are front and rear views of the WASH push button for the switch of FIG. 67.
Figure 88:
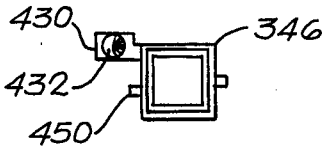
Figure 89:
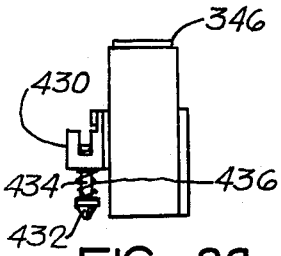
FIGS. 89, 90, 91 and 92 are four side views, showing the four sides of the WASH push button.
Figure 90:
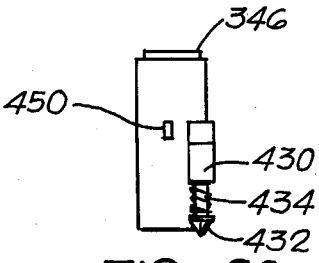
Figure 91:
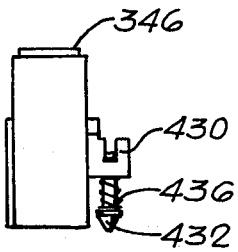
Figure 92:
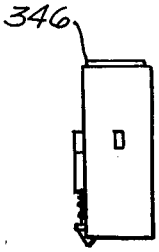

When the WASH push button 346 is depressed, the conical contactor 432 is moved rearwardly with the push button 346, until the contactor 432 comes into bridging engagement with two fixed contacts 440 and 442, shown in FIG. 73. Such contacts 440 and 442 may be in the form of flanges, made of copper or some other electrically conductive material. The contact flange 440 is formed in one piece with an electrical terminal 444, extending through the rear casing wall 368 and staked or otherwise secured thereto. In this case, the contact flange 442 is wound on an M-shaped bracket 446 which is riveted or otherwise secured to the electrical terminal 398. FIGS. 99–103 illustrate details of the contacts 440 and 442, the terminal 444 and the bracket 446.

Figure 115:
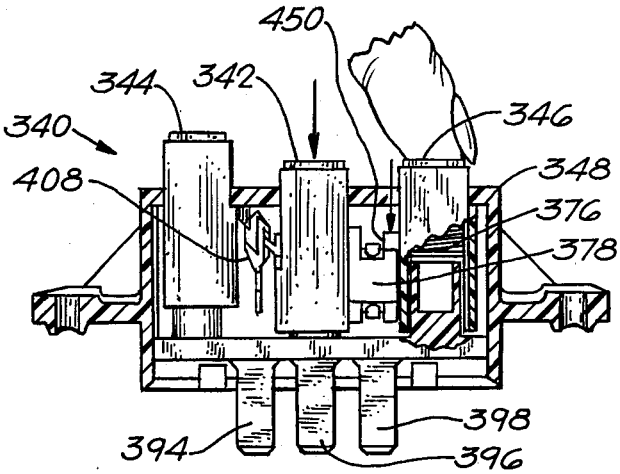
FIG. 115 is a longitudinal section, showing the depression of the WASH push button and the resulting depression and latching of the ON push button.
Figure 120:
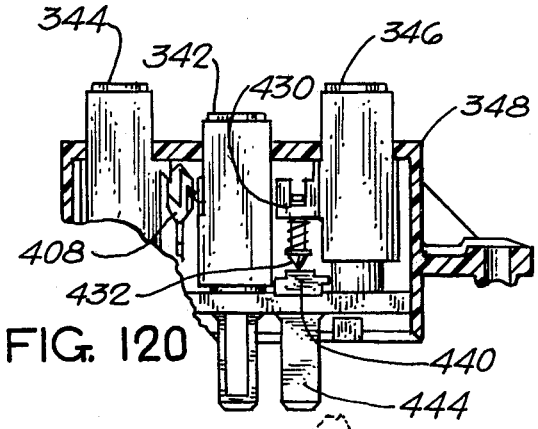
FIGS. 120 and 121 are fragmentary longitudinal sections showing the WASH push button in its extended and depressed positions, respectively.
Figure 121:
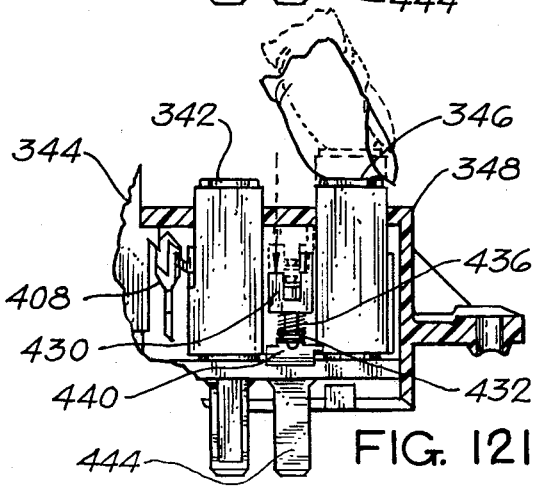
Figure 124:
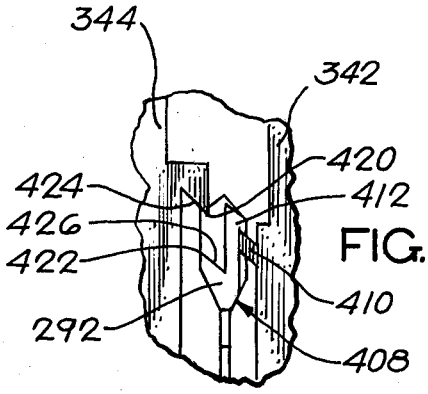
FIGS. 124, 125, 126 and 127 show four successive stages in the movement of the latching member as the ON push button is unlatched by the depression of the OFF push button, FIG. 127 representing the return of both push buttons to their extended positions.

In FIGS. 73 and 120, the WASH push button 346 is shown in its extended or initial position. In FIGS. 115 and 121, the WASH push button 346 is shown in its depressed position. As the WASH push button 346 is depressed, the conical contactor 432 engages the contact flanges 440 and 442, which arrest the rearward movement of the contactor. Further depression of the push button 346 causes compression of the contactor spring 436, as shown in FIG. 121. The slidable, spring-biased mounting of the contactor 432 provides for a substantial overtravel of the push button 346, relative to the contactor 432.

Figure 116:
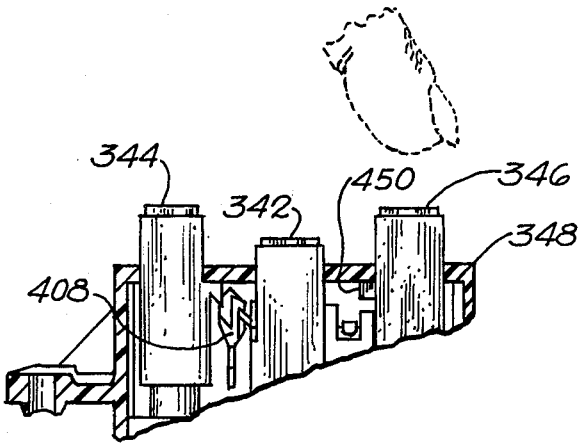
FIG. 116 is a fragmentary longitudinal section, showing the return of the WASH push button to its extended position.

A mechanical interlock is provided, so that depression of the WASH push button 346 causes depression of the ON push button 342 and latching of the ON push button in its depressed position. As shown in FIGS. 115 and 116, such mechanical interlock resides in the provision of a lateral projection or finger 450 on the WASH push button 346, adapted to engage the carriage 378 which projects laterally from the ON push button 342. When the WASH push button 346 is depressed, as shown in FIG. 115, the projection 450 engages and moves the carriage 378 along with the push button 346, so that the ON push button 342 is also depressed. The ON push button 342 is latched in its depressed position, as already described, the same as when the ON push button is depressed by itself. When the WASH push button 346 is released, it is returned to its extended position by its return spring 376, as shown in FIG. 116, but the ON push button 342 remains latched in its depressed position. As previously described, the ON push button 342 can be unlatched by depressing the OFF push button 344, as shown in FIGS. 122 and 123.

Figure 114:
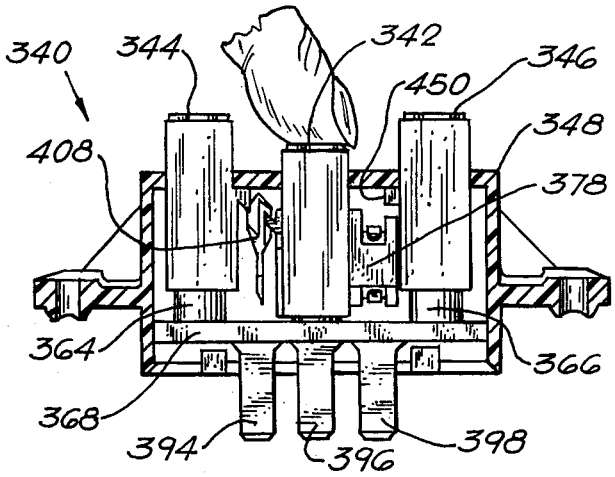
FIG. 114 is a longitudinal section showing the latching of the ON push button in its depressed position.

It may be helpful to summarize the operation of the push button switch 340 of FIGS. 67–127 and 130. The ON push button 342 may be depressed manually, as shown in FIGS. 107, 108 and 114. The contactor 380 is thereby moved rearwardly, along with the carriage 378 on the ON push button 342. Initially, the contactor 380 engages the contact plates 384 and 386, to complete an electrical circuit between the terminals 394 and 396, as shown in FIGS. 109 and 110. When the push button 342 is depressed, the contactor 380 is moved into engagement with the contact plates 386 and 388, as shown by the successive positions of FIGS. 111 and 112, so as to complete an electrical circuit between the terminals 396 and 398. This circuit may be employed to energize the windshield wiper motor.

The ON push button 342 is latched in its depressed position by the latching action shown in FIGS. 114–120. As the push button 342 is depressed, the latching or ratchet tooth 410 on the push button 342 engages the latching or ratchet tooth 412 on the enlarged head 292 of the flexible latching arm 408, so that the latching arm is deflected to the left, as shown in FIGS. 117 and 118. The latching tooth 410 moves past the tooth 412, whereupon the latching arm 408 is returned to its original position by its own resilience, as shown in FIGS. 119 and 120. The latching tooth 412 on the latching arm 408 prevents the return of the latching tooth 410 on the ON push button 342.

The ON push button 342 can be unlatched by depressing the OFF push button 344, as shown in FIGS. 122–127. As the OFF push button is depressed from its extended position of FIG. 124, the unlatching tooth 424 on the push button 344 engages the unlatching tooth 422 on the resilient latching arm 408, as shown in FIG. 125. The camming action between the ramp surfaces 424 and 426 deflects the enlarged head 292 of the latching arm 408 to the left, as shown in FIG. 126, with the result that the latching tooth 412 on the arm 408 is moved out of engagement with the latching tooth 410 on the ON push button 342. Accordingly, the ON push button 342 is returned to its extended position by its return spring 372, as shown in FIGS. 123 and 127. When the OFF push button 344 is released, it is returned to its extended position by its return spring 374.

When the ON push button 342 is thus returned to its extended position, the contactor 380 is returned into engagement with the contact plates 384 and 386, so as to complete an electrical circuit between the terminals 394 and 396. This circuit may be employed to complete the parking circuit for the windshield wiper motor.

When it is desired to energize the washer pump or other device, the wash push button 346 is depressed, as shown in FIGS. 115 and 121. This also causes depression of the ON push button 342, because the laterally projecting finger 450 on the WASH push button 346 engages the carriage 378 on the ON push button 342 and carries it rearwardly, as shown in FIG. 115, whereupon the ON push button 342 is latched in its depressed position, as previously described. The depression of the WASH push button 346 also causes the conical wash contactor 432 to engage the contact flanges 440 and 442, as will be seen from FIGS. 73 and 121, which represent the extended and depressed positions of the WASH push button 346. The contactor 432 thus completes an electrical circuit between the terminals 398 and 444, so that the wash pump is energized. The simultaneous depression of the ON push button 342, by virtue of the mechanical interlock afforded by the finger 450, energizes the windshield wiper motor, which continues to operate until the OFF push button 344 is depressed to unlatch the ON push button 342, as previously described.

When the WASH push button 346 is released, it is returned to its extended position by its return spring 376, as shown in FIG. 73, so that the contactor 432 is moved out of engagement with the contact flanges 440 and 442.

The conical shape of the WASH contactor 432 causes it to center itself between the contact flanges 440 and 442. Moreover, such conical shape produces a wiping action between the contactor 432 and the contact flanges 440 and 442, so that the contacting surfaces are kept clean and bright. As shown in FIGS. 101 and 104, the contact flanges 440 and 442 may be formed with arcuate notches 460 and 462, forming contact edges, adapted to be engaged by the conical or tapering contactor 432, to assist in centering the contactor 432 between the contact flanges 440 and 442.

The WASH push button 346 may also be depressed when the ON push button 342 has already been depressed, in which case the wash contactor 432 engages the contact flanges 440 and 442 and completes the electrical circuit between the terminals 398 and 444, so as to energize the wash pump.

It will be seen that the flexible resilient arm 408 is formed with all of the elements needed to serve as a latching arm for the push button switch 340 of FIGS. 67–127, and also all of the elements to serve as a blocking arm for the push button switch 210 of FIGS. 24–66. Thus, the latching arm 408 and the blocking arm 232 are identical in construction. This arrangement makes is possible to employ the same molding components for molding the blocking arm 232 and the latching arm 408.

It will also be seen that most of the other details of the casing 348 of FIG. 67 are the same as for the casing 216 of FIG. 24. Thus, the two casings can be molded in a single composite mold, having different inserts to mold the two slightly different casings.

FIGS. 131–133 illustrate a modified contact construction for the push button switch 340 of FIGS. 67–127 and 130. It will be seen from FIG. 131 that the contact plate 386 is formed with a longitudinal rib 460 which projects slightly into the path of the contactor 380. The rib 460 is aligned with the projections 192. As the contactor 380 is moved along the contact plate 386, it rides along the rib 460, as shown in FIGS. 132 and 133. The rounded beads 172 of the contactor 380 slide along the rib 460. As shown in FIG. 132, the front bead 172 on the contactor 380 engages the rib 460, while the rear bead engages the contact plate 388. Due to the projection of the rib 460, the contactor 380 is slightly tilted.

As the contactor 380 is moved in a forward direction, the rear bead 172 rides up on the rib 460, while the front bead 172 rides down from the front end of the rib 460 until it comes into engagement with the front contact plate 384. This causes the contactor 380 to tilt in the opposite direction, relative to the tilt shown in FIG. 132. By virtue of this tilting action, the rib 460 may be employed to produce a positive break-before-make operation, so that the electrical contact between the contactor 380 and the rear contact plate 388 is broken, before the contact is made between the front bead 172 of the contactor 380 and the front contact plate 384. In this switch, the life of the switch is prolonged by achieving this break-before-make action.

We claim:

1. A push button switch, comprising
first and second parallel push buttons,
a casing having first and second guide means for guiding said first and second push buttons along parallel closely spaced paths,
said push buttons being movable between extended and depressed positions,
resilient means biasing each of said push buttons toward said extended position,
switching means in said casing and operable by movement of said first push button,
said casing being molded from a resinous plastic material,
a flexible resilient latching spring arm molded in one piece with said casing and extending between said first and second push buttons,
cooperative latching elements on said first push button and said latching spring arm for causing deflection of said latching spring arm followed by latching of said first push button in its depressed position,
and cooperative unlatching elements on said second push button and said arm for deflecting said arm and thereby causing disengagement of said latching elements in response to depression of said second push button.

2. A push button switch according to claim 1,
in which said latching elements comprise latching ratchet teeth on said first push button and said latching spring arm for causing deflection of said arm in response to depression of said first push button followed by return movement of said arm to bring said teeth into a latching relationship.

3. A push button switch according to claim 2,
in which said unlatching elements comprise camming elements on said second push button and said latching spring arm for deflecting said arm to cause disengagement of said latching elements in response to depression of said second push button.

4. A push button switch according to claim 1,
in which said unlatching elements comprise ramp surfaces on said second push button and said latching spring arm for deflecting said arm to cause disengagement of said latching elements in response to depression of said second push button.

5. A push button switch according to claim 1,
including a third push button movable between extended and depressed positions,
said casing having third guide means for guiding said third push button along a path generally parallel with the paths of said first and second push buttons,
additional resilient means biasing said third push button toward its extended position,
momentary contact switching means in said casing and operable by movement of said third push button,
and interengaging elements on said third push button and said first push button for causing depression and latching of said first push button when said third push button is depressed and released.

6. A push button switch according to claim 5,
in which said interengaging elements include a laterally projecting element on said third push button,
and a lateral projection on said first push button in the path of said laterally projecting element and engageable by said laterally projecting element upon depression of said third push button to depress said first push button therewith.

7. A push button switch according to claim 1, in which
said latching elements include means for causing deflection of said latching spring arm in a predetermined direction followed by latching of said first push button in its depressed position in response to movement of said first push button between its extended and depressed positions,
said unlatching elements including a ramp surface for deflecting said latching spring arm in said predetermined direction to cause disengagement of said latching elements in response to depression of said second push button.

8. A push button switch,
comprising first, second and third parallel push buttons movable between extended and depressed positions,
a casing having guide means for guiding said push buttons along parallel closely spaced paths,
resilient means individually biasing each of said push buttons toward its extended position,
first switching means in said casing and operable by movement of said first push button, said casing being molded from a resinous plastic material, a flexible resilient latching spring arm molded in one piece with said casing and extending between said first and second push buttons, cooperative latching elements on said first push button and on said latching spring arm for causing deflection of said latching spring arm followed by latching of said first push button in its depressed position in response to movement of said first push button between its extended and depressed positions, cooperative unlatching elements on said second push button and on said arm for deflecting said arm and thereby causing disengagement of said latching elements in response to depression of said second push button, momentary contact switching means in said casing and operable by depression of said third push button, and interengageable lateral projections on said third push button and on said first push button for causing depression and latching of said first push button by said latching spring arm when said third push button is depressed and released, said third push button thereupon being freely returned to its extended position by said resilient means.

* * * * *